US008800818B2

(12) United States Patent
Greenberg

(10) Patent No.: US 8,800,818 B2
(45) Date of Patent: Aug. 12, 2014

(54) MULTI-CHAMBER DISPENSER

(76) Inventor: Evan Greenberg, Channelview, TX (US)

( * ) Notice: Subject to any disclaimer, the term of this patent is extended or adjusted under 35 U.S.C. 154(b) by 516 days.

(21) Appl. No.: 12/850,293

(22) Filed: Aug. 4, 2010

(65) Prior Publication Data

US 2012/0031925 A1 Feb. 9, 2012

(51) Int. Cl.

| | |
|---|---|
| ***B67D 7/70*** | (2010.01) |
| ***B67D 7/06*** | (2010.01) |
| ***B65D 81/32*** | (2006.01) |
| ***B65D 83/68*** | (2006.01) |
| ***B65D 83/20*** | (2006.01) |
| ***B65D 83/22*** | (2006.01) |
| ***B05B 11/00*** | (2006.01) |
| *A45D 40/24* | (2006.01) |

(52) U.S. Cl.

CPC ..... *B65D 81/3288* (2013.01); *B65D 83/68* (2013.01); *A45D 40/24* (2013.01); *B65D 83/206* (2013.01); *B65D 83/22* (2013.01); *B65D 83/205* (2013.01); *A45D 2200/057* (2013.01); *B05B 11/3084* (2013.01); *B05B 11/3059* (2013.01)

USPC ..... 222/135; 222/144.5; 222/145.1; 222/153.13; 222/265; 222/266; 222/275; 222/325

(58) Field of Classification Search

USPC ..... 222/135, 137, 144.5, 145.5, 145.1, 136, 222/153.13, 265, 266, 275, 325, 381, 41, 222/42, 48

See application file for complete search history.

(56) References Cited

U.S. PATENT DOCUMENTS

| | | | | |
|---|---|---|---|---|
| 3,084,871 | A | | 4/1963 | Puglis |
| 3,211,343 | A | * | 10/1965 | Silver ..... 222/144.5 |
| 3,596,802 | A | * | 8/1971 | Feldman ..... 222/135 |
| 3,722,750 | A | | 3/1973 | Fox |
| 3,942,902 | A | * | 3/1976 | Pajala et al. ..... 401/45 |
| 4,006,841 | A | * | 2/1977 | Alticosalian ..... 222/42 |
| 4,549,674 | A | | 10/1985 | Alticosalian |
| 4,838,457 | A | * | 6/1989 | Swahl et al. ..... 222/48 |
| 4,982,877 | A | * | 1/1991 | Burton ..... 222/135 |
| 5,152,431 | A | * | 10/1992 | Gardner et al. ..... 222/136 |
| 5,411,176 | A | * | 5/1995 | Favre ..... 222/94 |

(Continued)

FOREIGN PATENT DOCUMENTS

| | | |
|---|---|---|
| GB | 1 464 280 | 2/1977 |
| JP | 63 111968 | 7/1988 |
| JP | 2005 096834 | 4/2005 |

OTHER PUBLICATIONS

International Search Report for PCT/US2011/046580 issued Oct. 10, 2011.

*Primary Examiner* — Kevin P Shaver
*Assistant Examiner* — Nicholas J Weiss
(74) *Attorney, Agent, or Firm* — Ropes & Gray LLP

(57) ABSTRACT

A multi-chamber dispenser may be provided and may include one or more chambers that may be removably fastened to a rigid frame and/or one or more chambers that may be permanently fastened to the rigid frame. A chamber may be actuated by rotating a cap, or an actuator, or both, to an application position and then pressing the cap or actuator in order to dispense the substance of one or more chambers. The substance may be dispensed via an independent dispensing conduit or a shared dispensing conduit. The multi-chamber dispenser may operate in any orientation and may operate when less than all of the chambers are fastened to the dispenser.

19 Claims, 30 Drawing Sheets

SECTION D-D

(56) References Cited

U.S. PATENT DOCUMENTS

| | | | | |
|---|---|---|---|---|
| 5,433,350 | A * | 7/1995 | Graubart | 222/136 |
| 5,568,883 | A * | 10/1996 | Cataneo et al. | 222/136 |
| 5,833,121 | A | 11/1998 | Gueret | |
| 6,464,107 | B1 * | 10/2002 | Brugger | 222/134 |
| 6,659,311 | B2 * | 12/2003 | Prueter | 222/136 |
| 6,945,430 | B2 * | 9/2005 | Bloc | 222/135 |
| 7,090,097 | B1 * | 8/2006 | Kazarian et al. | 222/144.5 |
| 7,222,752 | B2 * | 5/2007 | Ponton | 222/134 |
| 7,240,808 | B2 * | 7/2007 | Brugger | 222/135 |
| 2004/0238567 | A1 | 12/2004 | Bloc | |
| 2004/0251274 | A1 | 12/2004 | Ponton | |
| 2010/0044394 | A1 * | 2/2010 | Milian et al. | 222/135 |

* cited by examiner

SECTION C-C

SECTION B-B

SECTION D-D

SECTION A-A

SECTION B-B

SECTION C-C

SECTION D-D

SECTION E-E

SECTION F-F

SECTION B-B

SECTION A-A

SECTION D-D

SECTION C-C

SECTION E-E

SECTION F-F

SECTION A-A

SECTION B-B

SECTION D-D

SECTION C-C

SECTION E-E

MULTI-CHAMBER DISPENSER

FIELD OF THE INVENTION

This invention relates to dispensers and, more particularly, this invention relates to pump and spray dispensers having one or more chambers.

BACKGROUND OF THE INVENTION

Dispensers typically include a pump or spray valve permanently affixed to a single chamber. When the contents of that chamber are fully withdrawn, the entire dispenser is discarded, including the pump or spray valve that is still in good working order. Moreover, these dispensers are typically designed to dispense a single type of product. However, there are a variety of dispensable products that a consumer may wish to purchase, and it may be difficult or cumbersome to efficiently distribute these products to a consumer because each requires its own respective dispenser. For example, a typical family trip to the beach may necessitate packing suntan lotion, hand soap, bug spray, and antiperspirant. This requires four separate dispensers, typically of varying sizes and shapes, which makes it difficult to pack efficiently for the trip.

Accordingly, it would be desirable to provide a dispenser having one or more chambers that may each contain various substances.

SUMMARY OF THE INVENTION

In view of the foregoing, apparatus and methods are provided for multi-chamber dispensers.

The dispensers of the present invention may include one or more chambers that may be removably fastened to a rigid frame and/or one or more chambers that may be permanently fastened to the rigid frame. A chamber may be actuated by rotating a cap, or an actuator, or both, to an application position and then pressing the cap or actuator in order to dispense the substance of one or more chambers. The substance may be dispensed via an independent dispensing conduit or a shared dispensing conduit. The multi-chamber dispenser may be operable in any orientation and may be operable when less than all of the chambers are fastened to the dispenser. The chambers may be any suitable size.

In accordance with an embodiment, there is provided a multi-chamber dispenser having a rigid frame portion that is configured to be coupled with a plurality of chambers, where the interior of each of the plurality of chambers may be configured to contain a respective substance. A rotatable cap may be positioned at a dispensing end of the dispenser and coupled to the rigid frame portion, where the rotatable cap may be configured to rotate to an application position and actuate at least one of the plurality of chambers in order to allow that chamber's substance to be dispensed.

In accordance with an embodiment, there is provided a dispensing chamber having a rigid housing configured to contain a substance, where the rigid housing includes an attachment portion that removably couples with a rigid frame of a dispenser, where the rigid frame is configured to couple with a plurality of dispensing chambers. An actuating portion may be coupled to the rigid housing and may be operable to dispense the substance from the housing when the attachment portion is coupled to the rigid frame of the dispenser.

In accordance with an embodiment, there is provided a multi-chamber dispenser having a rigid frame portion that is coupled with a plurality of chambers, where the interior of each of the plurality of chambers may be configured to contain a respective substance. A rotatable cap may be positioned at a dispensing end of the dispenser and coupled to the rigid frame portion, where the rotatable cap may be configured to rotate to an application position and actuate at least one of the plurality of chambers in order to allow that chamber's substance to be dispensed.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 87:
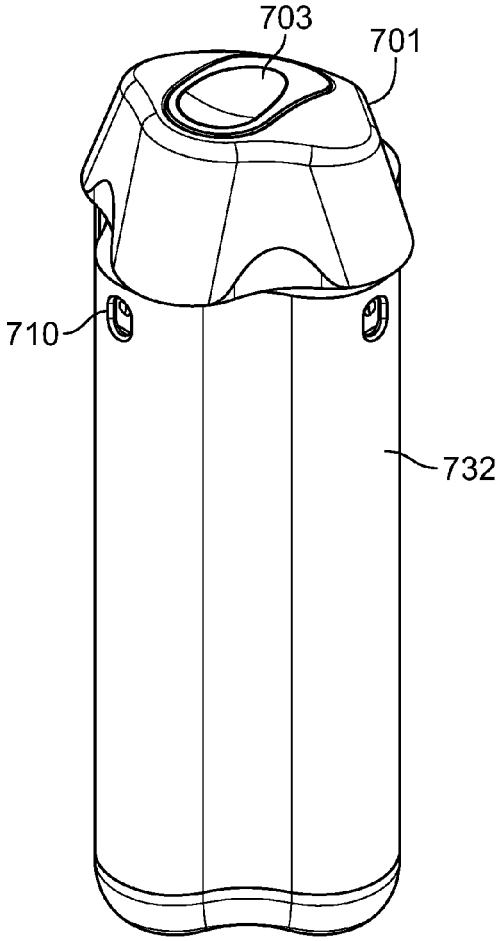
FIG. 87 shows a perspective view of an illustrative multi-chamber dispenser according to an embodiment of the invention.

Apparatus and methods are provided for multi-chamber dispensers, and are described below with reference to FIGS. 1-87 and Examples 1-7. It will be understood that the features described in connection with any of Examples 1-7 are not exclusive to that particular example and may be combined, in whole or in part, with the features of any other exemplary embodiment.

The present invention relates to multi-chamber dispensers for dispensing, for example, various fluids including liquids, gases, and mixtures of liquids, solids, and gases, any other suitable fluids, or combinations thereof. It will be understood that while the present invention is described herein in the context of portable pump and spray dispensers, the concepts discussed are applicable to any dispensing configuration, including, but not limited to, various industrial applications where the dispenser may or may not be portable and/or machine-operated, any other suitable configuration, or combinations thereof. Moreover, it will be understood that although the present invention is described herein as having one or more removable chambers, some chambers may be non-removable. For example, at least one non-removable chamber may be provided in a dispenser having one or more removable chambers.

As defined herein, a "substance" is any viscous or non-viscous fluid that may be used, for example, in various automotive and industrial applications including, but not limited to, polishes, de-icers, cleaners, lubricants and oils, glass cleaners, engine cleaners, degreasers, and freezer sprays; personal care and cosmetics applications including, but not limited to, hair sprays, shaving creams, gels, and foams, deodorants, body sprays, antiperspirants, mousses, and skin care products such as cleansers, toners, sunblocks, suntan lotions, self-tanning solutions, and foundations; food applications including, but not limited to, whipped creams, condiments, and oils; household applications including, but not limited to, glass cleaners, oven cleaners, carpet cleaners and refreshers, air fresheners, insecticides, furniture polish, wood care sprays, bathroom and kitchen cleaning foams, starch sprays, shoe polishes, paints, and lacquers; and medical applications including, but not limited to, disinfectant sprays, lotions, and gels, asthma inhalers, and burn creams, gels, and sprays. It will be understood that this list is not exhaustive and that a substance in the context of the present invention may be virtually any viscous or non-viscous fluid.

As defined herein, a "chamber" is any suitable container or vessel that may contain or substantially contain a substance and may be configured to be fastened to a dispenser. Suitable chambers may include, for example, pump bottles, spray bottles, cartridges, or any other such suitable container or vessel.

Example 1

FIGS. 1-17 show various perspectives and schematic cross-sectional views of an illustrative multi-chamber dispenser according to some embodiments of the present invention. Multi-chamber dispenser 100 may include one or more pump bottles or removable chambers 111-114 that may be removably fastened to a rigid frame of dispenser 100 (e.g., rigid frame 126 of FIG. 13). Although dispenser 100 is shown as having up to four removable chambers 111-114, it will be understood that any suitable number of removable chambers may be provided. Moreover, although each removable chamber 111-114 is shown as being substantially the same type (i.e., a pump bottle), it will be understood that any suitable type of removable chamber may be provided (e.g., various pump bottles and spray bottles or cartridges) in any suitable combination, and each chamber may contain any suitable respective substance or substances that may be dispensed by dispenser 100. Each of chambers 111-114 may contain the same substance or may contain different substances as any one or more of the other chambers.

A cap 101 may be positioned at a dispensing end of dispenser 100 and may include a top portion 102, a radial portion 104, and a front dispensing portion 106. Cap 101 may be rotatable to various dispensing/application positions. For example, as shown in FIGS. 1-4, cap 101 is rotated to an application position for first pump bottle or removable chamber 111. Front dispensing portion 106 may include a chamfer or lip portion 108 and a slot 110 having a dispenser head extending therefrom, such as dispenser head 182 of FIG. 5, for dispensing a substance from a selected chamber. Although the cross-sectional area of slot 110 is substantially rectangular, it may be any other suitable shape, and of any other suitable size, configured to allow a dispenser head to extend therefrom. For example, the cross-sectional area of slot 110 may be substantially rectangular, triangular, circular or elliptical, hexagonal, any other desired shape, or any combination thereof.

Figure 1:
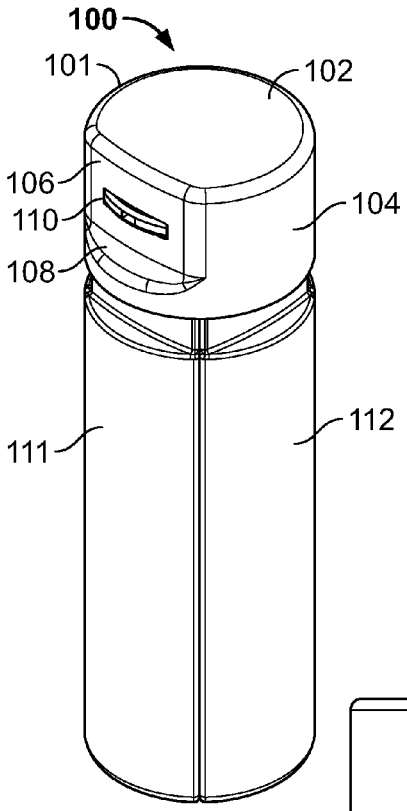
FIG. 1 shows a perspective view of an illustrative multi-chamber dispenser according to an embodiment of the invention.
Figure 2:
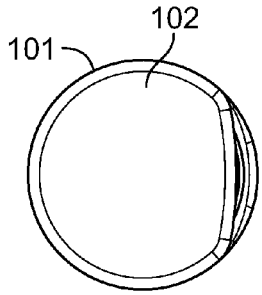
FIG. 2 shows a top plan view of the illustrative multi-chamber dispenser of FIG. 1 according to an embodiment of the invention.
Figure 3:
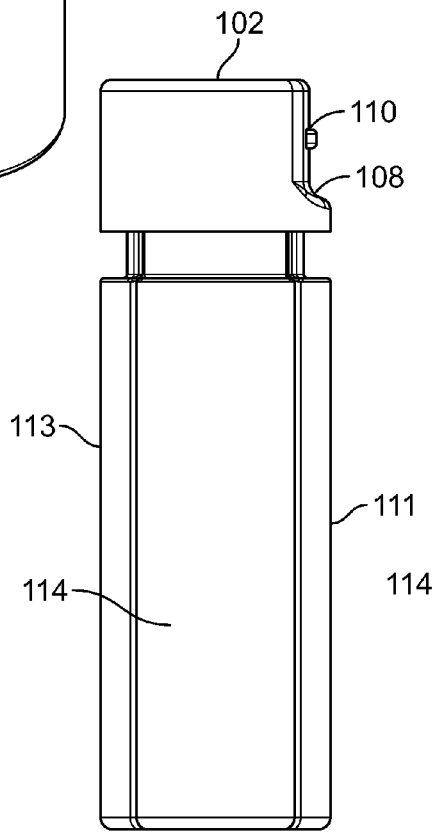
FIGS. 3 and 4 show a side and a front elevation view, respectively, of the illustrative multi-chamber dispenser of FIG. 1 according to embodiments of the invention.
Figure 4:
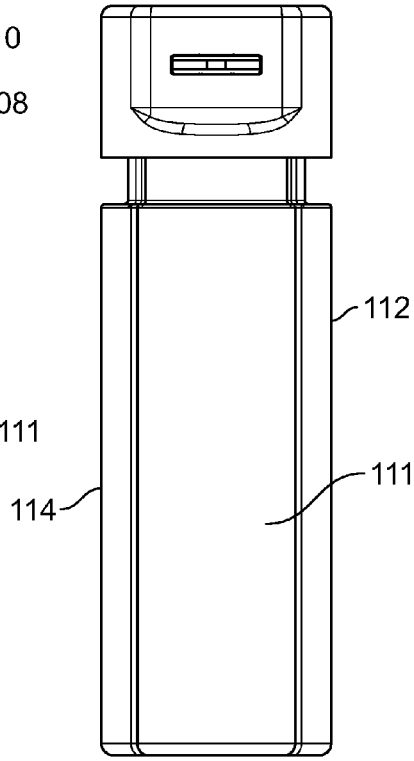
Figure 5:
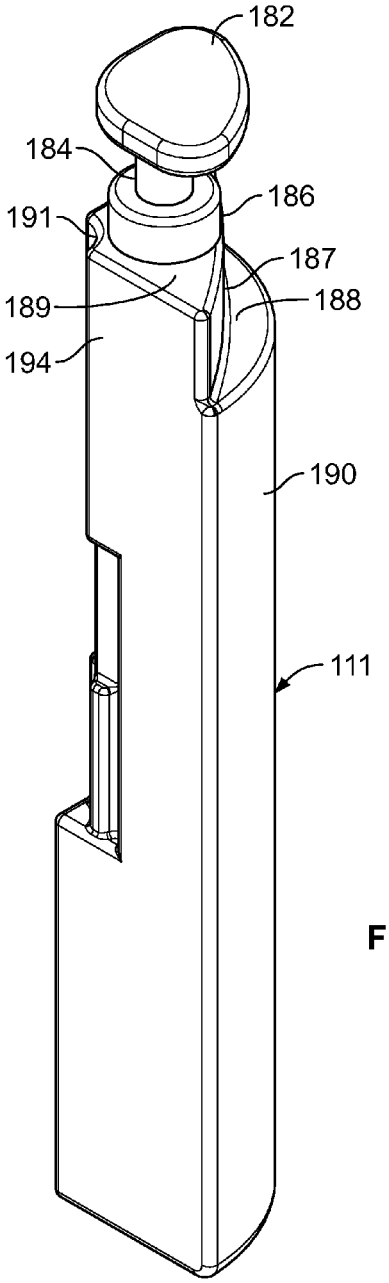
FIG. 5 shows a perspective view of an illustrative removable chamber according to an embodiment of the invention.

In some embodiments, the cap may be rotatable to various application positions and the entire cap may be depressed in order to actuate at least one of the chambers (e.g., cap 101 of FIG. 1). In some embodiments, the cap may be rotatable to various application positions, and the cap may include an actuator. The actuator may be depressed in order to actuate at least one of the chambers (e.g., cap 201 and actuator 203 of FIG. 18). In some embodiments, the cap may be fixedly positioned in a stationary location on the dispenser, and the cap may include an actuator. The actuator may be rotatable to various application positions and the actuator may be depressed in order to actuate at least one of the chambers (e.g., cap 301 and actuator 303 of FIG. 33). In some embodiments, any suitable combination of rotatable or non-rotatable caps and/or actuators may be provided according to any of these embodiments.

Figure 6:
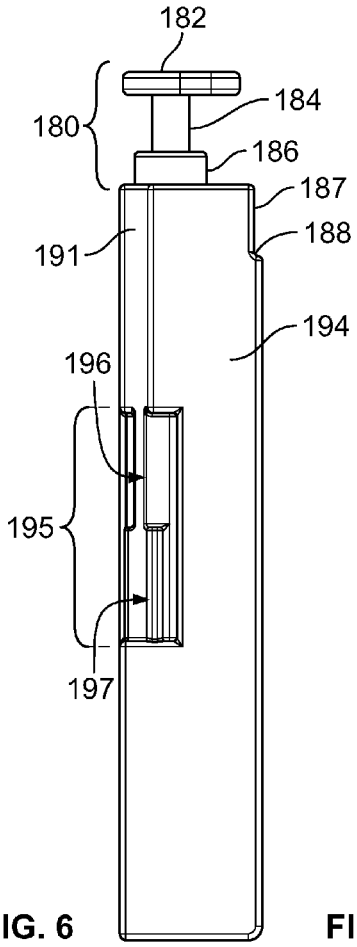
FIGS. 6 and 7 show side elevation views of the illustrative removable chamber of FIG. 5 according to embodiments of the invention.
Figure 7:
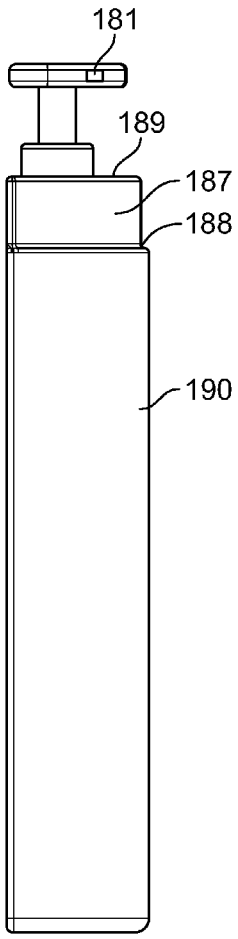
Figure 8:
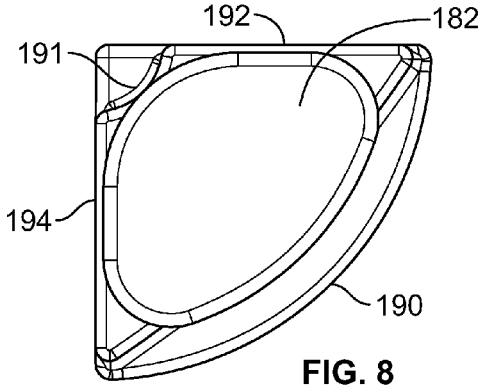
FIG. 8 shows a top plan view of the illustrative removable chamber of FIG. 5 according to an embodiment of the invention.
Figure 9:
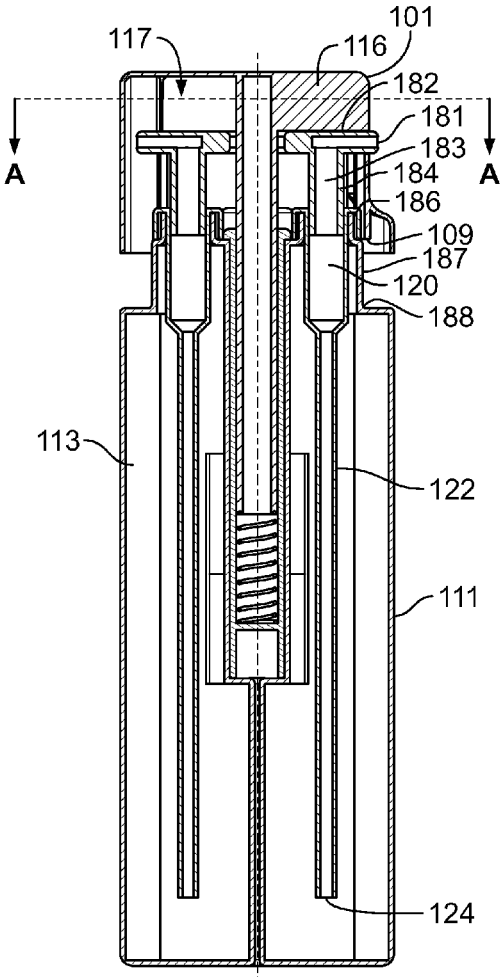
FIG. 9 shows a schematic cross-sectional view of the illustrative multi-chamber dispenser of FIG. 1 according to an embodiment of the invention.

Dispenser 100 may include one or more chambers, each chamber having a pump attached thereto, such as pump 180 of first chamber 111 of FIG. 6. FIGS. 5-8 show various perspectives of first pump bottle or removable chamber 111 according to some embodiments of the invention. Pump 180 may include, for example, dispenser head 182, piston or neck portion 184, cylindrical sleeve 186, and, as shown in FIG. 9, pump chamber 120 and collecting tube 122. Dispensing chamber 111 may also include a frame interface cutout 191, internal surfaces 192 and 194, outer surface 190, and offset outer surface 187. Each dispensing chamber may also include interlock portion 195 having an opening 196 therein and a mating portion 197 therein for fastening the respective chamber to the frame of dispenser 100 (e.g., rigid frame 126 of FIG. 13). Fastening the dispensing chambers to the rigid frame is discussed in more detail below with reference to FIG. 13.

Interior surfaces 192 and 194 of first chamber 111 may oppose the corresponding interior surfaces of other dispensing chambers, if any, fastened to dispenser 100, while outer surface 190 may be oriented radially outwardly from dispenser 100. Outer surface 190 of chamber 111 may provide an interface by which a user may hold and/or operate dispenser 100 and may be configured for grasping thereof by a user's hand. In some embodiments, for example, outer surface 190 may be textured to increase the friction between outer surface 190 and a user's hand. Alternatively or additionally, in some embodiments outer surface 190 may be covered or wrapped with an elastic or flexible material including various rubbers, polymers, nylons, or any other suitable elastic or flexible material, or combinations thereof that may increase the friction between outer surface 190 and a user's palm. Moreover, in some embodiments interior surfaces 192 and 194 may also be textured and/or covered or wrapped with various materials for increasing the friction between interior surfaces 192 and 194 and a user's hand. This may increase the friction about substantially the entirety of chamber 111, thereby providing a non-slip interface for grasping thereof to securely insert chamber 111 into dispenser 100. Moreover, in some embodiments chamber 111 may be operated independently from dispenser 100 because pump 180 may be attached to chamber 111, and the increased friction of interior surfaces 192 and 194 and outer surface 190 may be provided for users to thus operate chamber 111 securely, for example. It will be understood that in some embodiments materials may be chosen without regard, or with relatively less regard, to friction.

The user may actuate pump 180, for example, by rotating cap 101 into an application position and pressing or actuating cap 101 axially downwards, which each time pumps a quantity of fluid or other substance from at least one of removable chambers 111-114, the quantity of fluid or other substance determined by the internal and/or external characteristics of pump 180. For example, each depression of cap 101, thereby actuating pump 180, may cause a preferred amount of substance to be expelled from within a dispensing chamber (e.g., dispensing chamber 111). Pump 180 may operate by producing a negative pressure in the suction or collecting tube 122, which may cause the substance present within the selected chamber to pass through opening 124 of collecting tube 122, pump chamber 120, dispensing conduit 183 within piston 184, and thence into the dispenser head 182 and out nozzle 181.

Any suitable pump may be used in the dispensers of the present invention. For example, in some embodiments pump 180 may be a vertically reciprocating vacuum pump. Such pumps may operate, for example, by using a one-way valve positioned between the pump chamber (e.g., pump chamber 120) and the collecting tube (e.g., collecting tube 122). The one-way valve may control the flow of a substance into the pump chamber from the collecting tube, but may prevent or substantially prevent the reverse flow of the substance. A spring may be provided inside the pump chamber that may engage the bottom of the piston (e.g., piston 184) and bias the piston upwards. A second valve may be located in the dispensing conduit adjacent the piston (e.g., dispensing conduit 183) that may permit the flow of the substance from the pump chamber through the dispenser head, but may prevent or substantially prevent the reverse flow of the substance.

By pressing the dispenser head downwardly into the pump chamber, the piston may move downwardly therein and compress the substance (or sometimes the external air or any other external fluid) in the pump chamber. This may cause the first one-way valve to close and the second one-way valve to open. The substance in the pump chamber may move upwardly past the second one-way valve and through the piston and may be dispensed from the dispenser head at the top of the pump. Releasing the dispenser head may allow the spring in the pump chamber to push the piston upwardly relative to the pump chamber thereby creating a vacuum in the pump chamber. The vacuum may cause the second one-way valve to close and the first one-way valve to open, drawing the substance from the container into the pump chamber. Thus, the downward and upward manipulation of the dispenser head and/or piston relative to the pump chamber may each time draw the substance from the chamber.

It will be understood that the foregoing discussion of an illustrative vertically reciprocating vacuum pump is merely exemplary, and various modifications may be made to the pump. For example, in some embodiments more, or fewer, valves may be provided (if any at all). As another example, the pump may be configured to operate with more than one chamber. Moreover, it will be understood that any suitable type of pump may be provided with a dispenser. For example, in some embodiments, the dispenser of the present invention may include a vertically reciprocating vacuum pump, any other suitable pump, or any combination thereof.

A pump of the present invention may be operable regardless of whether the dispenser is placed upright, inverted, or on its side, or in any other suitable orientation. Alternatively, a pump of the present invention may be configured to operate only in a certain orientation or orientations. For example, in some embodiments it may be desirable to only allow the pump to operate in a preferred orientation. Moreover, the dispenser of the present invention may be operable when less than all of the chambers are fastened to the dispenser. For example, in a dispenser configured to receive four chambers, the dispenser may be operable when less than four chambers are fastened to the rigid frame.

Figure 10:
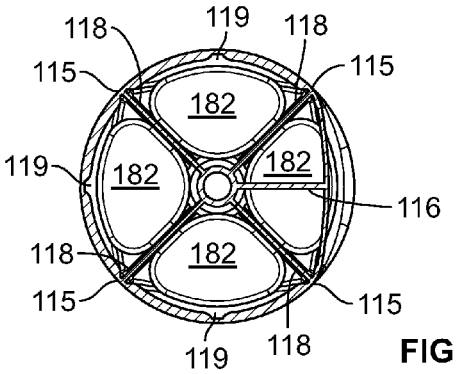
FIG. 10 shows a schematic cross-sectional view of the illustrative multi-chamber dispenser of FIG. 9, taken along line A-A, according to an embodiment of the invention.
Figure 11:
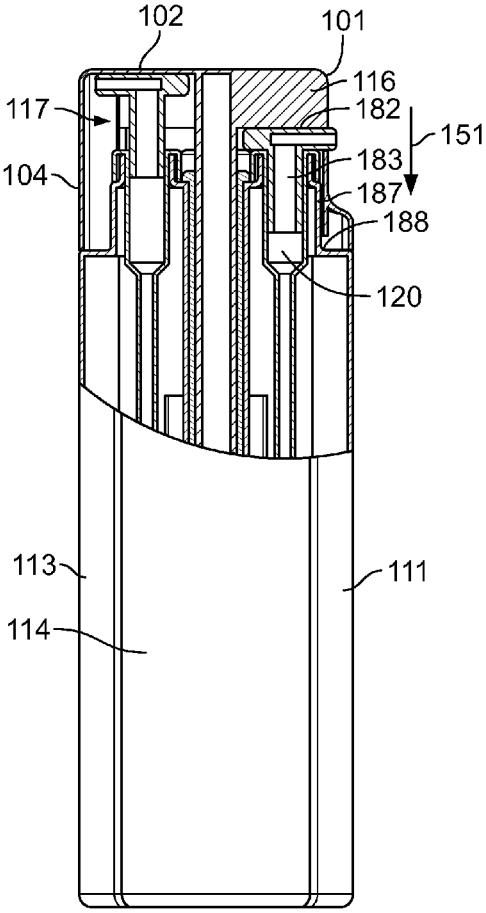
FIG. 11 shows a schematic cross-sectional view of the illustrative multi-chamber dispenser of FIG. 1 according to an embodiment of the invention.

A chamber may be selected and/or actuated according to various embodiments as shown in FIGS. 9-11. The interior of cap 101 may include a selecting rib 116 and locking ribs 118. Each locking rib 118 may engage, for example, with a respective position detent in a dispensing position 115 or lockout position 119 of dispenser 100. As shown in FIG. 10, locking ribs 118 are engaged with position detents in dispensing position 115. First pump bottle or removable chamber 111 may be selected, for example, by rotating cap 101 into dispensing position 115 whereby the selecting rib 116 may be aligned with first chamber 111. In this position, front dispensing portion 106 may be substantially aligned with the outer surface of chamber 111 (e.g., outer surface 190 of chamber 111 of FIG. 5). Selecting rib 116 of cap 101 may be configured to engage dispenser head 182 of pump 180 within chamber 111.

Referring now to FIG. 11, in order to dispense the substance or substances of selected chamber 111, cap 101 may be pressed axially downwards (in the direction of arrow 151), thereby actuating pump 180 via dispenser head 182 that is engaged with the selecting rib 116. Cap 101 may translate downward towards chambers 111-114 until the bottom lip of radial cap surface 104 proximately contacts the lower edge 188 of offset outer surface 187 of chamber 111. As shown in FIG. 11, for example, actuating pump 180 via dispenser head 182 causes piston 184 to retract into pump chamber 120 (compared to the position of piston 184 in FIG. 9), thereby creating a negative pressure and drawing a substance out of chamber 111 via opening 124 of collecting tube 122.

In some embodiments, one or more ridges may be provided that may provide tactile feedback as a user depresses cap 101. For example, a ridge (not shown) may be provided on the interior surface of radial cap portion 104 that may contact a reciprocal ridge on the exterior of offset outer surface 187 of at least one of the removable chambers. Cap 101 may "click" as it passes each ridge, thereby informing a user, depending on the number of "clicks," approximately how far cap 101 has traveled and therefore approximately how much substance is being dispensed. It will be understood that for a given travel distance of cap 101, each pump need not dispense the same quantity of substance from a respective chamber. For example, a plurality of chambers may be provided, each having its own respective pump, and the amount of substance dispensed may vary, for example, based on the type of substance within each chamber.

In some embodiments, cap 101 may be configured to only select a single chamber. In some embodiments, cap 101 may be configured to select more than one chamber. For example, the selecting rib 116 of cap 101 may be configured to align with the dispenser heads 182 of more than one chamber (not shown). In each of these embodiments, however, it will be understood that cap 101 may substantially prevent the non-selected chambers from being actuated.

As shown in FIGS. 9 and 11, the clearance space 117 above non-selected chambers 112-114 may substantially prevent non-selected chambers 112-114 from being actuated. For example, when cap 101 is in a substantially fully depressed position, the inside surface of top cap portion 102 may contact or nearly contact the dispensing head of one or more of the non-selected chambers 112-114 without actuating the dispensing head, thereby preventing the substance or substances from the non-selected chambers from being dispensed. The clearance of clearance space 117 as shown in FIGS. 9 and 11 (e.g., the distance between the inside surface of top portion 102 of rotatable cap 101 and a dispensing head, both before and after cap 101 is depressed) is merely illustrative, and it will be understood that clearance space 117 may be any suitable distance that may prevent non-selected chambers (e.g., chambers 112-114) from being actuated when a selected chamber (e.g., chamber 111) is actuated.

Figure 12:
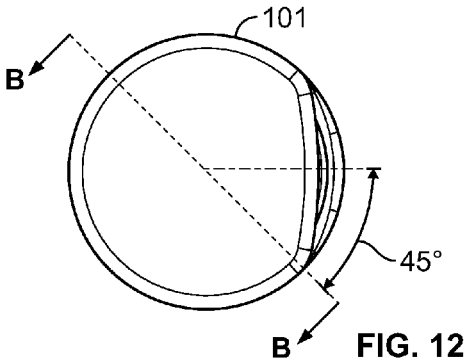
FIG. 12 shows a top plan view of the illustrative multi-chamber dispenser of FIG. 1 according to an embodiment of the invention.
Figure 13:
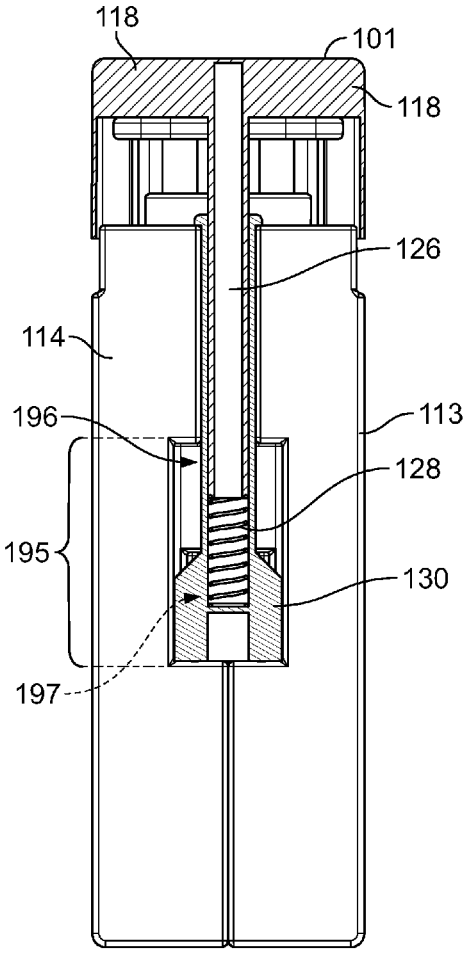
FIG. 13 shows a schematic cross-sectional view of the illustrative multi-chamber dispenser of FIG. 12, taken along line B-B, according to an embodiment of the invention.
Figure 14:
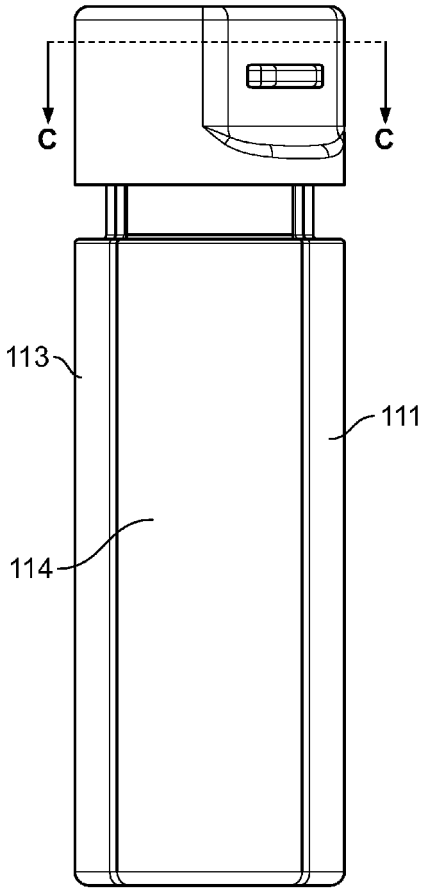
FIG. 14 shows a side elevation view of the illustrative multi-chamber dispenser of FIG. 1 according to an embodiment of the invention.

As shown in FIGS. 12 and 13, for example, dispenser 100 may include rigid frame 126 having bottle retention or docking dovetails 130 and, in some embodiments, spring 128. Docking dovetails 130 may be used for attaching one or more chambers 111-114 to dispenser 100 via the interlock portions 195 of the respective chambers 111-114. For example, as shown in FIG. 13, interlock portion 195 of chamber 114 may be configured to removably attach chamber 114 to rigid frame 126. This may be done, for example, by positioning opening 196 adjacent to docking dovetails 130, such that one or more dovetails are substantially enclosed by opening 196, and then sliding chamber 114 along docking dovetails 130 towards the dispensing end of dispenser 100 (e.g., towards cap 101) until mating portion 197 is securely and removably fastened with docking dovetail 130. Chamber 114 may be removed by sliding chamber 114 away from the dispensing end of dispenser 100 until docking dovetails 130 have disengaged from mating portion 197 by translating to opening 196 of interlock portion 195.

Rotatable cap 101 may be configured to rotate about rigid frame 126. In some embodiments, rotatable cap 101 may rotate relative to rigid frame 126. In other embodiments, for example, a rotatable cap and a rigid frame may rotate together. It will be understood that in some embodiments, a combination of these approaches may be used either in whole or in part. For example, a rotatable cap may rotate relative to some portions of a rigid frame while moving substantially synchronously with other portions of the rigid frame.

Figure 15:
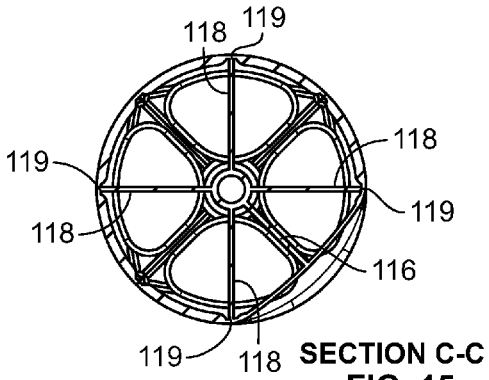
FIG. 15 shows a schematic cross-sectional view of the illustrative multi-chamber dispenser of FIG. 14, taken along line C-C, according to an embodiment of the invention.
Figure 16:
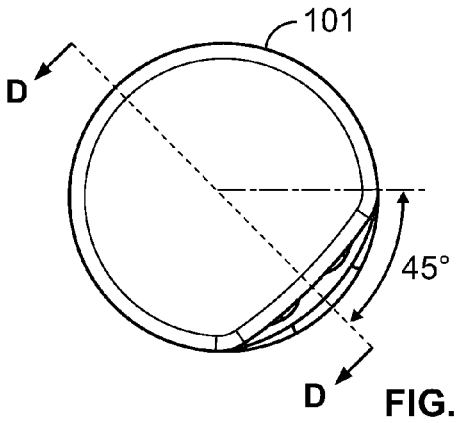
FIG. 16 shows a top plan view of the illustrative multi-chamber dispenser of FIG. 1 according to an embodiment of the invention.
Figure 17:
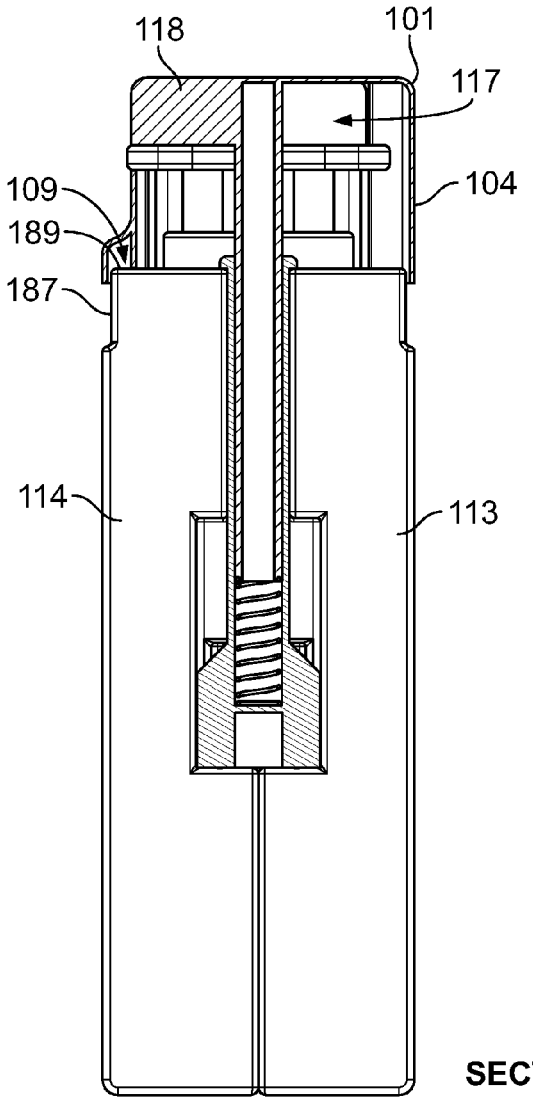
FIG. 17 shows a schematic cross-sectional view of the illustrative multi-chamber dispenser of FIG. 16, taken along line D-D, according to an embodiment of the invention.

As discussed above in connection with FIG. 10, there may be one or more lockout positions of dispenser 100 that may prevent a user from actuating any one of the one or more chambers 111-114 of dispenser 100. This may be useful, for example, when dispenser 100 is not being used. FIGS. 15-17 show illustrative embodiments of dispenser 100 in a lockout position. For example, as shown in FIG. 15, locking ribs 118 of cap 101 are engaged with position detents in a lockout position 119. In this illustrative example, rotatable cap 101 has been rotated 45-degrees clockwise from the application position shown in FIG. 10.

When a user attempts to depress cap 101 when cap 101 is in a lockout position, the bottom lip of radial cap surface 104 may clear offset outer edge 187 of the attached chambers 111-114. However, a catch tab or lockout tab 109 of cap 101 may strike the corner of at least one of the chambers at stop surface 189 which may act as a hard stop, preventing cap 101 from being further depressed and thereby preventing the selecting rib 116, or lockout ribs 118, or both, from actuating any of the pumps of the attached chambers 111-114. In some embodiments, there may be substantially no "travel" of cap 101 when depressed from a lockout position. For example, lockout tab 109 may be substantially adjacent to stop surface 189 thereby preventing cap 101 from substantially translating, or traveling, at all when pressure is applied to cap 101 either purposely or inadvertently. In some embodiments, cap 101 may travel or translate slightly when pressure is applied when cap 101 is in a lockout position. However, any such travel will be substantially limited such that no chamber may be actuated when cap 101 is in a lockout position.

Example 2

Figure 18:
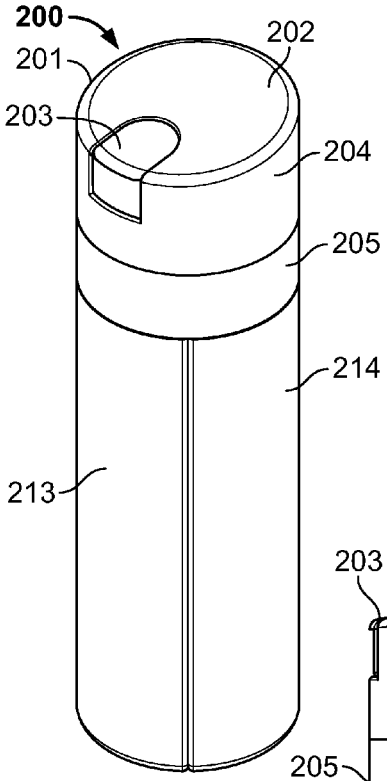
FIG. 18 shows a perspective view of an illustrative multi-chamber dispenser according to an embodiment of the invention.
Figure 19:
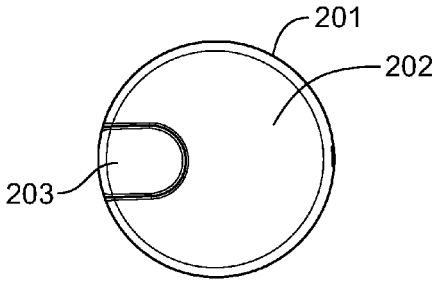
FIG. 19 shows a top plan view of the illustrative multi-chamber dispenser of FIG. 18 according to an embodiment of the invention.

FIGS. 18-32 show various perspectives and cross-sections of an illustrative multi-chamber dispenser according to some embodiments of the present invention. Multi-chamber dispenser 200 may include one or more pump bottles or removable chambers 211-214 that may be removably fastened to a rigid frame of dispenser 200 (e.g., rigid frame 226 of FIG. 24). As shown in FIG. 18, for example, outer periphery 205 of rigid frame 226 is exposed. Although dispenser 200 is shown as having up to four removable chambers 211-214 it will be understood that any suitable number of removable chambers may be provided. Moreover, although each removable chamber 211-214 is shown as being substantially the same type (i.e., a pump bottle), it will be understood that any suitable type of removable chamber may be provided (e.g., various pump bottles and spray bottles or cartridges) in any suitable combination, and each chamber may contain any suitable respective substance or substances that may be dispensed by dispenser 200. Each of chambers 211-214 may contain the same substance or may contain different substances as any one or more of the other chambers.

A rotatable cap 201 may be positioned at a dispensing end of dispenser 200 and may include a top portion 202, a radial portion 204, a front dispensing portion 206, and a button or actuator 203. Cap 201 may be rotatable to various dispensing/application positions. For example, as shown in FIGS. 18-21, cap 201 is rotated to an application position for third pump bottle or removable chamber 213. In some embodiments, rather than depressing the entire cap to actuate at least one of the chambers, for example, actuator 203 may be depressed to actuate at least one of chambers 211-214 to dispense a substance. This operation may be alternative, or additional, for example, to the operation of dispenser 100 as shown and described in FIGS. 1-17, where the entire cap 101 may be depressed to actuate a chamber.

Figure 20:
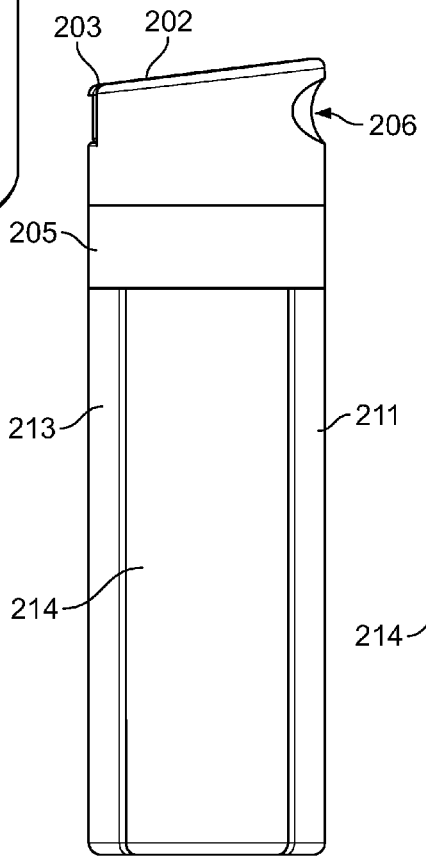
FIGS. 20 and 21 show a side and a front elevation view, respectively, of the illustrative multi-chamber dispenser of FIG. 18 according to embodiments of the invention.
Figure 21:
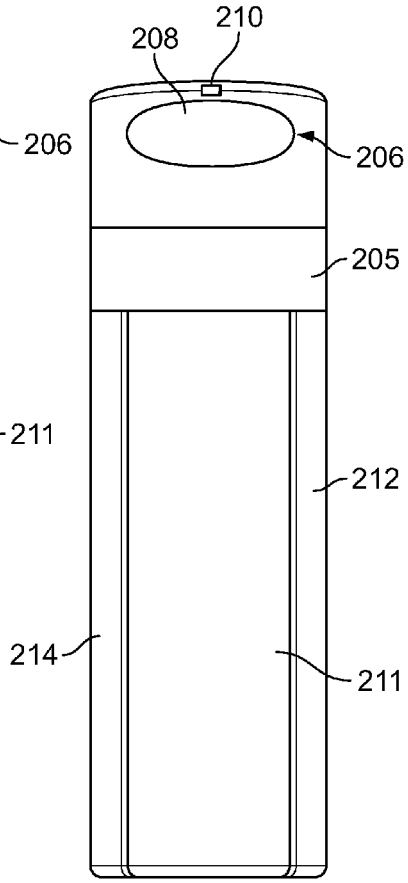

Front dispensing portion 206 may include a chamfer portion 208 and a dispensing outlet 210 for dispensing a substance from the selected chamber. Although the cross-sectional area of outlet 210 is substantially rectangular, it may be any other suitable shape, and of any other suitable size, configured to allow a substance to pass therethrough. For example, the cross-sectional area of outlet 210 may be substantially rectangular, triangular, circular or elliptical, hexagonal, any other desired shape, or any combination thereof. Chamfer portion 208 may also have any suitable shape. For example, as shown in FIGS. 20 and 21, chamfer portion 208 may be substantially ellipsoid. However, chamfer portion 208 may have any suitable shape or indent that may be used, for example, to provide a surface with which a user may grasp dispenser 200. In some embodiments front portion 206 may not be indented at all.

Figure 22:
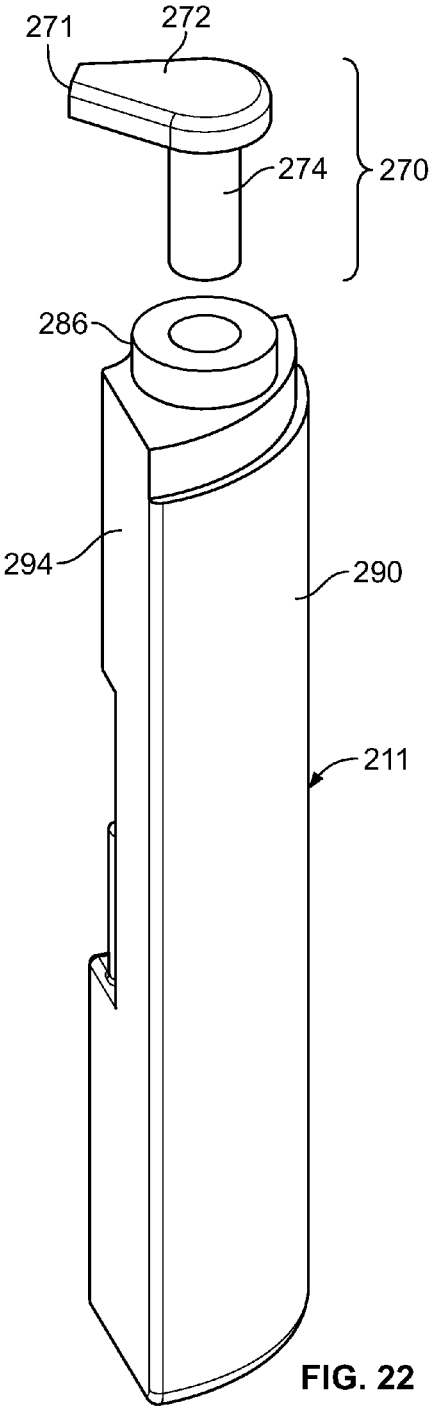
FIGS. 22 and 23 show perspective views of an illustrative removable chamber according to embodiments of the invention.
Figure 23:
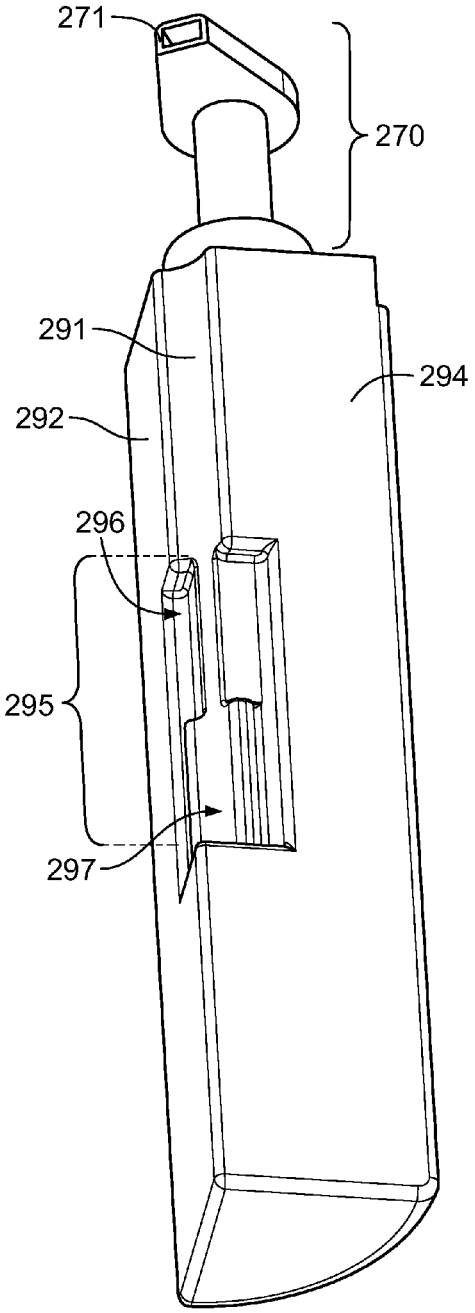
Figure 25:
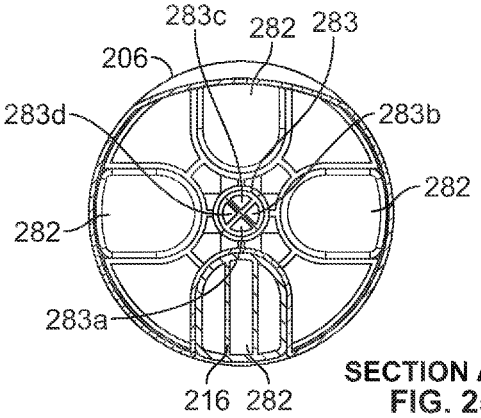
FIG. 25 shows a schematic cross-sectional view of the illustrative multi-chamber dispenser of FIG. 24, taken along line A-A, according to an embodiment of the invention.
Figure 26:
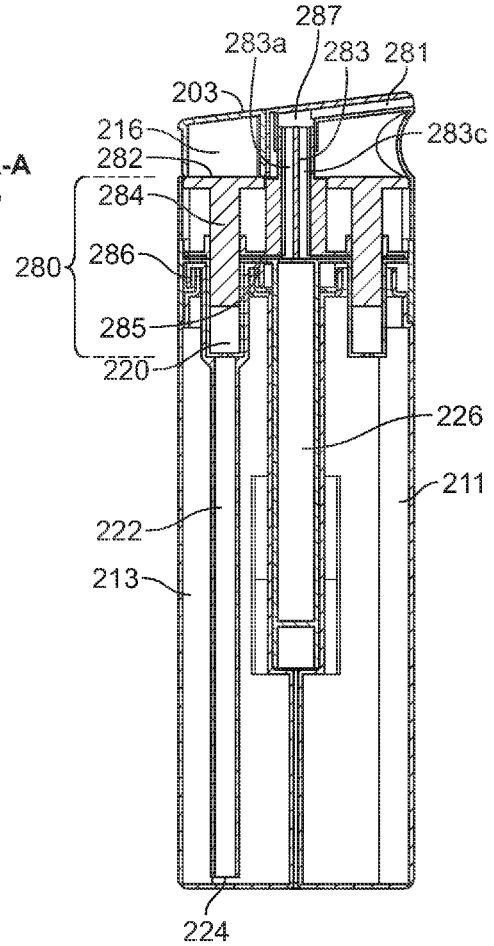
FIG. 26 shows a schematic cross-sectional view of the illustrative multi-chamber dispenser of FIG. 24, taken along line B-B, according to an embodiment of the invention.

FIGS. 22 and 23 show various perspectives of first pump bottle or removable chamber 211 according to embodiments of the invention. Chamber 211 may include, for example, cylindrical sleeve 286, and, as shown in FIG. 26, pump chamber 220 and collecting tube 222. Dispensing chamber 211 may also include a frame interface cutout 291, internal surfaces 292 and 294, and outer surface 290. Each dispensing chamber may also include interlock portion 295 having an opening 296 therein and a mating portion 297 therein for fastening a respective chamber to the frame of dispenser 200 (e.g., rigid frame 226 of FIG. 24). Fastening the dispensing chambers is discussed in more detail below with reference to FIG. 24.

Interior surfaces 292 and 294 of first chamber 211 may oppose the corresponding interior surfaces of other dispensing chambers, if any, fastened to dispenser 200, while outer surface 290 may be oriented radially outwardly from dispenser 200. Outer surface 290 of chamber 211 may provide an interface by which a user may hold and/or operate dispenser 200 and may be configured for grasping thereof by a user's hand. In some embodiments, for example, outer surface 290 may be textured to increase the friction between outer surface 290 and a user's hand. Alternatively or additionally, in some embodiments outer surface 290 may be covered or wrapped with an elastic or flexible material including various rubbers, polymers, nylons, or any other suitable elastic or flexible material, or combinations thereof that may increase the friction between outer surface 290 and a user's palm. Moreover, in some embodiments interior surfaces 292 and 294 may be similarly textured and/or covered or wrapped with various materials for increasing the friction between interior surfaces 292 and 294 and a user's hand. This may increase the friction about substantially the entirety of chamber 211, thereby providing a non-slip interface for grasping thereof to securely insert chamber 211 into dispenser 200. It will be understood that in some embodiments materials may be chosen without regard, or with relatively less regard, to friction.

Dispenser 200 may include one or more pumps attached to rigid frame 226, such as pump 280 of FIG. 26. It will be understood that any suitable type of pump may be provided as discussed above in connection with pump 180 of FIG. 6. Pump 280 may include, for example, dispenser head 282 and piston or neck portion 284. Because pumps 280 may be provided with rigid frame 226 of dispenser 200 rather than with individual chambers 211-214, in some embodiments chambers 211-214 may not be operable to dispense a substance unless they are fastened to dispenser 200. However, in some embodiments, an external pump (e.g., external pump 270 of FIGS. 22 and 23) may be provided that may include a dispenser head 272, a piston or neck portion 274, and a nozzle 271. External pump 270 may be configured to removably attach to one of chambers 211-214 for operation thereof when that respective chamber is not fastened to dispenser 200.

A chamber may be selected and/or actuated according to various embodiments as shown in FIGS. 24-29. The interior of cap 201 may include selecting ribs 216 of actuator 203. Third pump bottle or removable chamber 213 may be selected, for example, by rotating cap 201 into a dispensing position whereby the selecting ribs 216 may be aligned with dispenser head 282 proximate to third chamber 213. In this position, for example, front dispensing portion 206 may be substantially aligned with the outer surface of first chamber 211 (e.g., outer surface 290 of first chamber 211 of FIG. 22). The selecting ribs 216 of actuator 203 may thus be configured to engage dispenser head 282 of pump 280.

Figure 29:
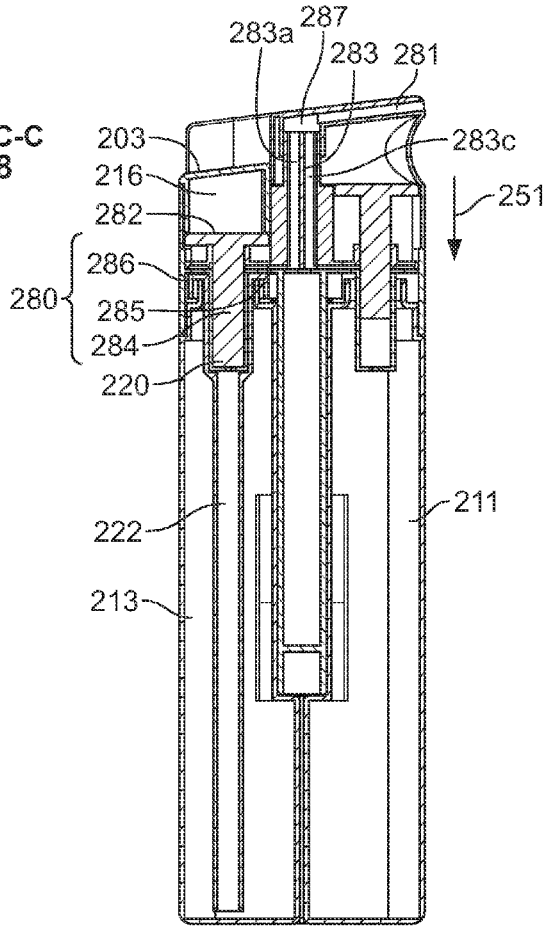
FIG. 29 shows a schematic cross-sectional view of the illustrative multi-chamber dispenser of FIG. 27, taken along line D-D, according to an embodiment of the invention.

Referring now to FIGS. 26 and 29, in order to dispense the substance or substances of selected chamber 213, actuator 203 may be pressed axially downwards (in the direction of arrow 251), thereby actuating pump 280 via dispenser head 282 that is engaged with the selecting ribs 216, which each time pumps a quantity of fluid or other substance from at least one of removable chambers 211-214, the quantity of fluid or other substance determined by the internal and/or external characteristics of pump 280. For example, each depression of actuator 203, thereby actuating pump 280, may cause a preferred amount of substance to be expelled from within a dispensing chamber (e.g., dispensing chamber 213). Actuator 203 may translate downward towards chambers 211-214 until piston 284 is substantially fully depressed into pump chamber 220. As shown in FIG. 29, for example, actuating pump 280 via dispenser head 282 causes piston 284 to retract into pump chamber 220 (compared to the position of piston 284 in FIG. 26), thereby creating a negative pressure and drawing a substance out of chamber 213 via opening 224 of collecting tube 222. The substance may then pass through pump chamber 220, passage 285, channel 283*a* and space 287 of shared dispensing conduit 283, and out nozzle 281. The shared dispensing conduit 283 has a plurality of channels 283*a*-283*d*, each respective channel associated with a respective chamber. The channels 283*a*-283*d* prevent mixing of the respective substances.

In some embodiments, one or more ridges may be provided that may provide tactile feedback as a user depresses actuator 203. For example, a ridge (not shown) may be provided on actuator 203 that may contact a reciprocal ridge on the interior of radial cap portion 204. Actuator 203 may "click" as it passes each ridge, thereby informing a user, depending on the number of "clicks," approximately how much substance is being dispensed. It will be understood that for a given travel distance of actuator 203, each pump need not dispense the same quantity of substance from a respective chamber. For example, a plurality of chambers may be provided, each attached via rigid frame 226 to its respective pump, and the amount of substance dispensed may vary, for example, based on the type of substance within each chamber.

In some embodiments, actuator 203 may be configured to only select a single chamber. In some embodiments, actuator 203 may be configured to select more than one chamber. For example, selecting ribs 216 of actuator 203 may be configured to align with the dispenser heads 282 of more than one chamber (not shown). In each of these embodiments, however, it will be understood that actuator 203 may substantially prevent the non-selected chambers from being actuated.

In some embodiments where more than one chamber may be actuated, shared dispensing conduit 283 may allow the substances from two or more chambers to be mixed prior to being dispensed. This operation may be useful, for example, for certain substances that are the product of two or more separate components that remain stable while separated but may have a limited shelf life when they are mixed together. Dispensers that have substances of this type that are mixed in a single chamber prior to being dispensed cannot remain in storage or on a store shelf for a prolonged period of time before the substance begins to lose its effectiveness. As another example, some liquid products may include one or more components that may not readily mix with each other including, for example, some water-based components and oil. In a chamber that contains substances of this type, the components may separate out causing a dispenser to dispense only that component that had settled to the bottom of the chamber. Accordingly, in some embodiments, dispenser 200 may keep two components separate from each other (i.e., in different chambers) until they are mixed together for the first time in shared dispensing conduit 283 just prior to their being dispensed from dispenser 200.

Figure 24:
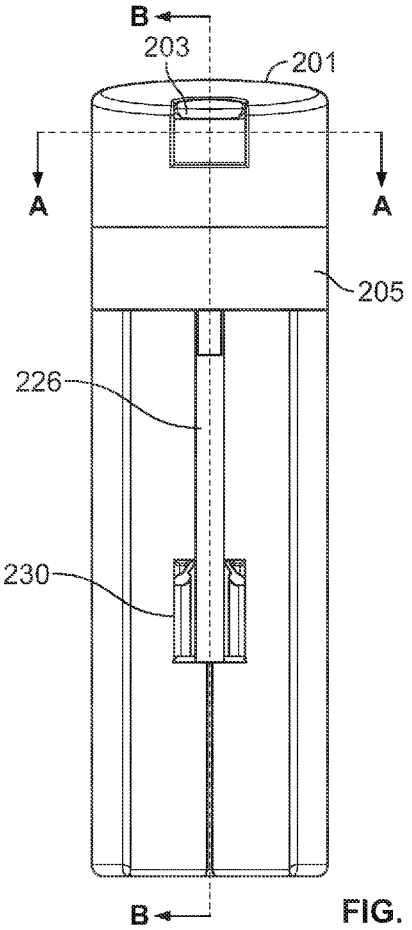
FIG. 24 shows a rear elevation view of the illustrative multi-chamber dispenser of FIG. 18 according to an embodiment of the invention.
Figure 28:
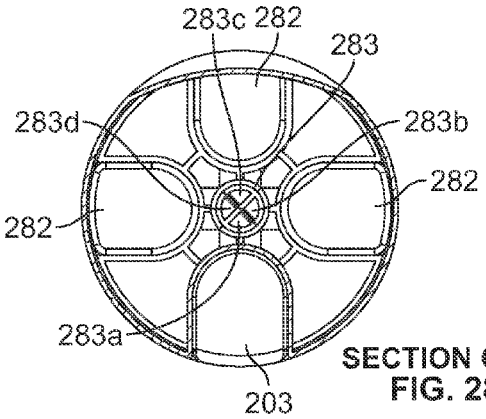
FIG. 28 shows a schematic cross-sectional view of the illustrative multi-chamber dispenser of FIG. 27, taken along line C-C, according to an embodiment of the invention.
Figure 27:
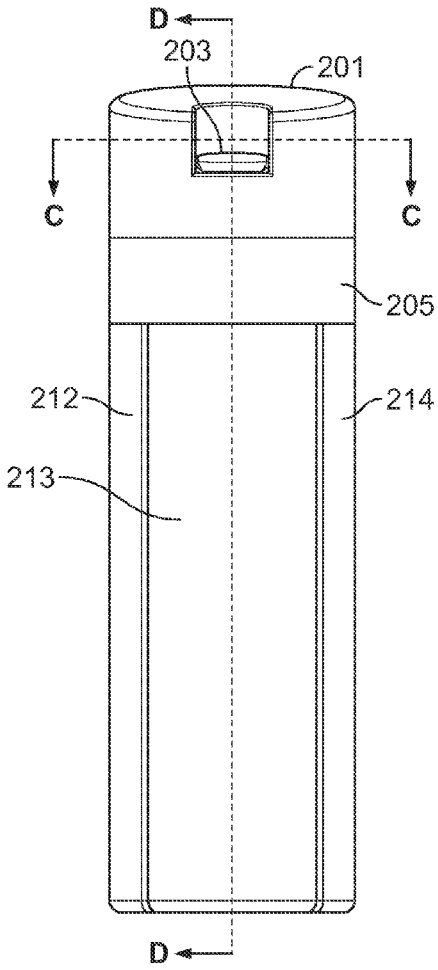
FIG. 27 shows a rear elevation view of the illustrative multi-chamber dispenser of FIG. 18 according to an embodiment of the invention.

As shown in FIG. 24, for example, dispenser 200 may include rigid frame 226 having bottle retention or docking dovetails 230. Docking dovetails 230 may be used for attaching one or more chambers 211-214 to dispenser 200 via the interlock portions 295 of the respective chambers 211-214 as previously described in connection with dispenser 100.

Figure 31:
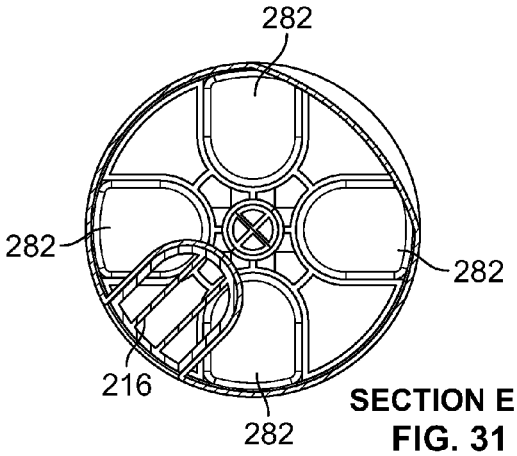
FIG. 31 shows a schematic cross-sectional view of the illustrative multi-chamber dispenser of FIG. 30, taken along line E-E, according to an embodiment of the invention.
Figure 30:
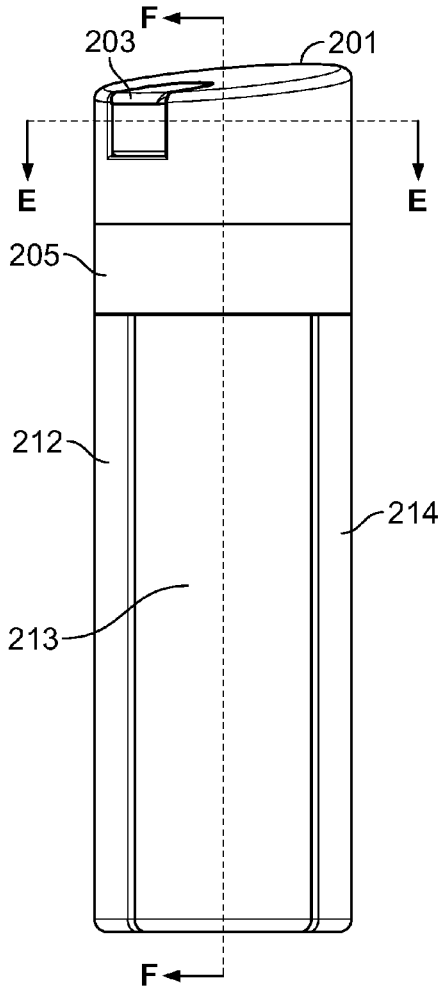
FIG. 30 shows a side elevation view of the illustrative multi-chamber dispenser of FIG. 18 according to an embodiment of the invention.
Figure 32:
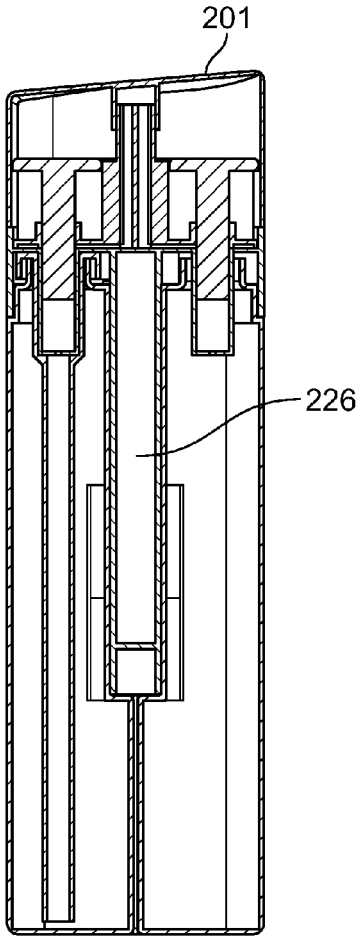
FIG. 32 shows a schematic cross-sectional view of the illustrative multi-chamber dispenser of FIG. 30, taken along line F-F, according to an embodiment of the invention.

There may be one or more lockout positions of dispenser 200 that may prevent a user from actuating any one of the one or more chambers 211-214 of dispenser 200. This may be useful, for example, when dispenser 200 is not being used. FIGS. 30 and 31 show illustrative embodiments of dispenser 200 in a lockout position. For example, as shown in FIG. 31, the selecting ribs 216 of actuator 203 are substantially blocked by the upper surface of rigid frame 205/226 from actuating any of dispenser heads 284. In this illustrative example, rotatable cap 201 has been rotated 45-degrees clockwise from the application position shown in FIG. 25.

Example 3

FIGS. 33-48 show various perspectives and cross-sections of an illustrative multi-chamber dispenser according to various embodiments of the present invention. Multi-chamber dispenser 300 may include one or more pump bottles or removable chambers 311-314 that may be removably fastened to a rigid frame of dispenser 300 (e.g., rigid frame 326 of FIG. 38). Although dispenser 300 is shown as having up to four removable chambers 311-314 it will be understood that any suitable number of removable chambers may be provided. Moreover, although each removable chamber 311-314 is shown as being substantially the same type (i.e., a pump bottle), it will be understood that any suitable type of removable chamber may be provided (e.g., various pump bottles and spray bottles or cartridges) in any suitable combination, and each chamber may contain any suitable respective substance or substances that may be dispensed by dispenser 300. Each of chambers 311-314 may contain the same substance or may contain different substances as any one or more of the other chambers.

A cap 301 may be positioned at a dispensing end of dispenser 300 and may include a top portion 302, a radial portion 304, and a rotatable button or actuator 303 having a front dispensing portion 306. Actuator 303 may be rotatable to various dispensing/application positions. For example, as shown in FIGS. 33-36, actuator 303 is rotated to an application position for first pump bottle or removable chamber 311.

Figure 33:
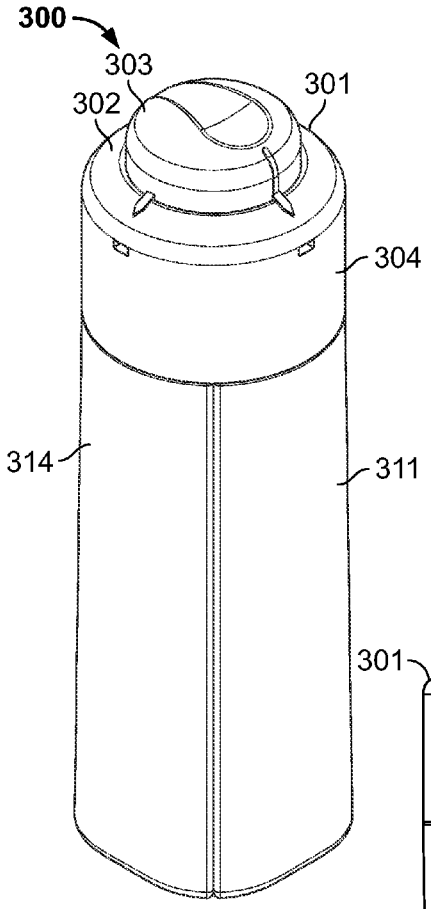
FIG. 33 shows a perspective view of an illustrative multi-chamber dispenser according to an embodiment of the invention.
Figure 34:
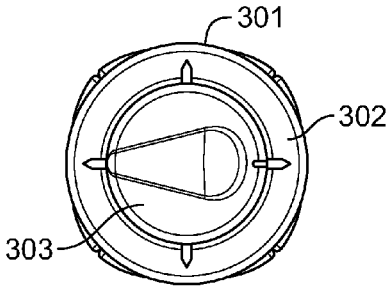
FIG. 34 shows a top plan view of the illustrative multi-chamber dispenser of FIG. 33 according to an embodiment of the invention.
Figure 35:
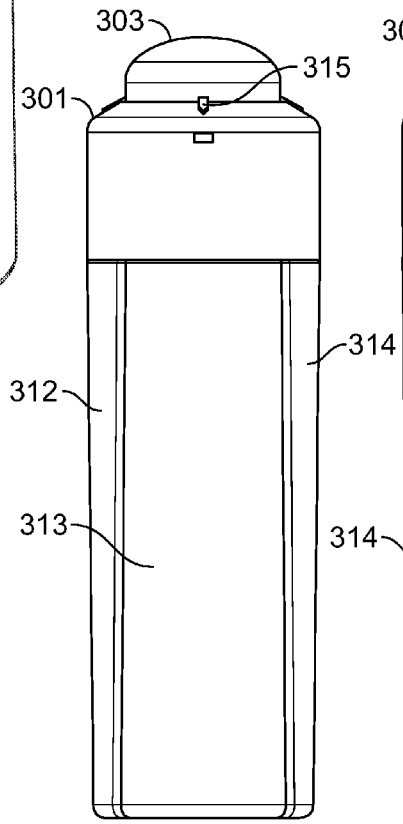
FIGS. 35 and 36 show a rear and a front elevation view, respectively, of the illustrative multi-chamber dispenser of FIG. 33 according to embodiments of the invention.
Figure 36:
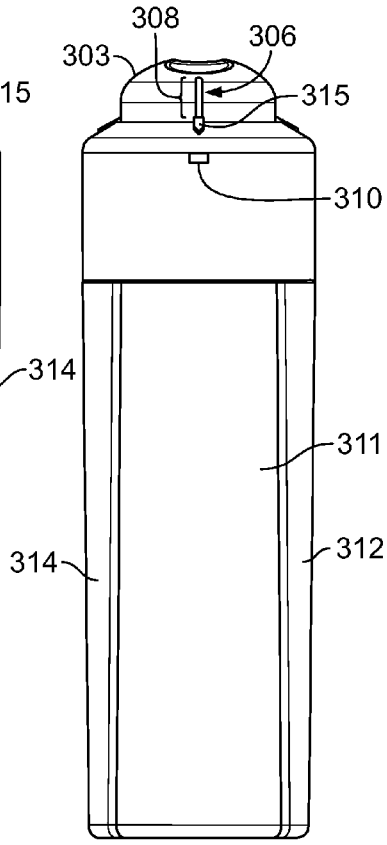

Front dispensing portion 306 of actuator 303 may include a chamfer portion 308 that visually or tactually indicates the position of actuator 303 relative to each of the chambers 311-314. In some embodiments, chamfer portion 308 may indicate the position of actuator 303 relative to each of chambers 311-314 via position element 315, which may be any suitable detent, extrusion, visual indication, or any other suitable position indicator or any combination thereof, that may indicate a dispensing position for a respective chamber. Cap 302 may include one or more dispensing outlets 310 about the radial cap surface 304, each corresponding to at least one of chambers 311-314, and each dispensing outlet 310 may be configured to dispense a substance therethrough. Although the cross-sectional area of outlets 310 is substantially rectangular, it may be any other suitable shape, and of any other suitable size, configured to allow a substance to pass therethrough. For example, the cross-sectional area of outlet 310 may be substantially rectangular, triangular, circular or elliptical, hexagonal, any other desired shape, or any combination thereof. Chamfer portion 308 may also have any suitable shape. For example, as shown in FIGS. 33 and 36, chamfer portion 308 may be substantially rectangular. However, chamfer portion 308 may have any suitable shape or indent that may be used, for example, to indicate the position of actuator 303 relative to each of chambers 311-314. In some embodiments, portion 308 may not be indented at all.

Figure 37:
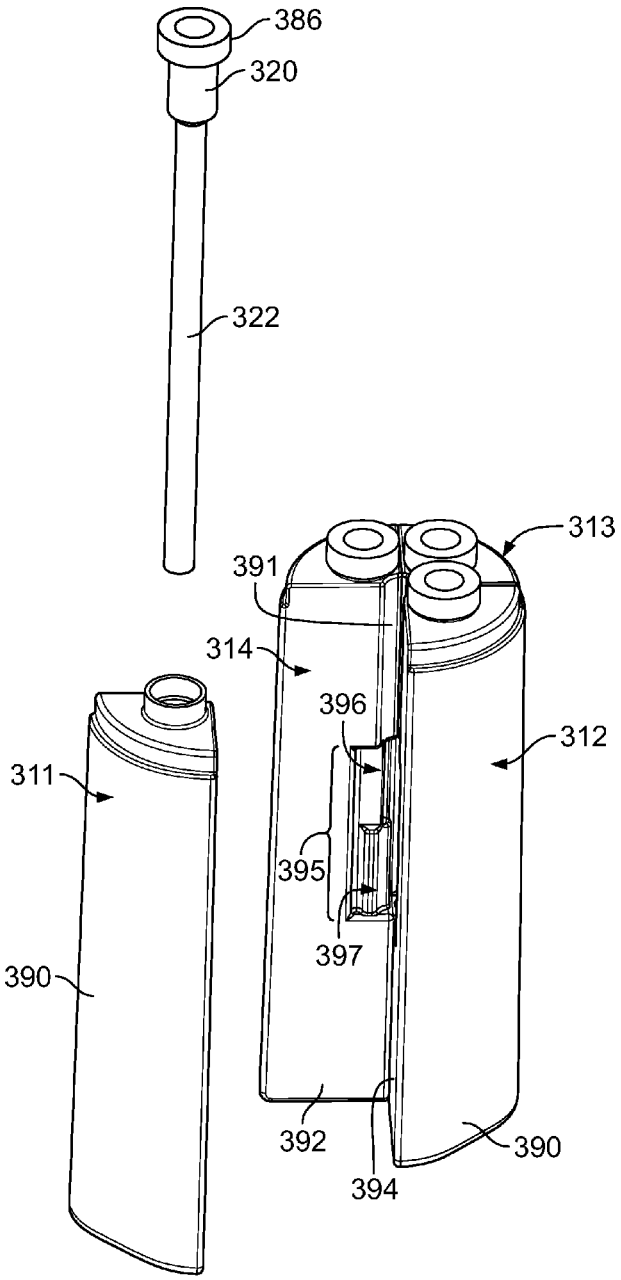
FIG. 37 shows a partially exploded perspective view of illustrative removable chambers according to embodiments of the invention.

FIG. 37 shows a partially exploded perspective view of illustrative removable chambers 311-314 according to an embodiment of the invention. For example, chamber 311 may include cylindrical sleeve 386, pump chamber 320, and collecting tube 322. The dispensing chambers may also include frame interface cutouts 391, internal surfaces 392 and 394, and outer surfaces 390. Each dispensing chamber may also include interlock portion 395 having an opening 396 therein and a mating portion 397 therein for fastening a respective chamber to the frame of dispenser 300 (e.g., rigid frame 326 of FIG. 38). Fastening the dispensing chambers is discussed in more detail below.

Interior surfaces 292 and 294 of first chamber 211 may oppose the corresponding interior surfaces of other dispensing chambers, if any, fastened to dispenser 200, while outer surface 290 may be oriented radially outwardly from dispenser 200. Outer surface 290 of chamber 211 may provide an interface by which a user may hold and/or operate dispenser 200 and may be configured for grasping thereof by a user's hand. In some embodiments, for example, outer surface 290 may be textured to increase the friction between outer surface 290 and a user's hand. Alternatively or additionally, in some embodiments outer surface 290 may be covered or wrapped with an elastic or flexible material including various rubbers, polymers, nylons, or any other suitable elastic or flexible material, or combinations thereof that may increase the friction between outer surface 290 and a user's palm. Moreover, in some embodiments interior surfaces 292 and 294 may be similarly textured and/or covered or wrapped with various materials for increasing the friction between interior surfaces 292 and 294 and a user's hand. This may increase the friction about substantially the entirety of chamber 311, thereby providing a non-slip interface for grasping thereof to securely insert chamber 311 into dispenser 300. It will be understood that in some embodiments materials may be chosen without regard, or with relatively less regard, to friction.

Figure 38:
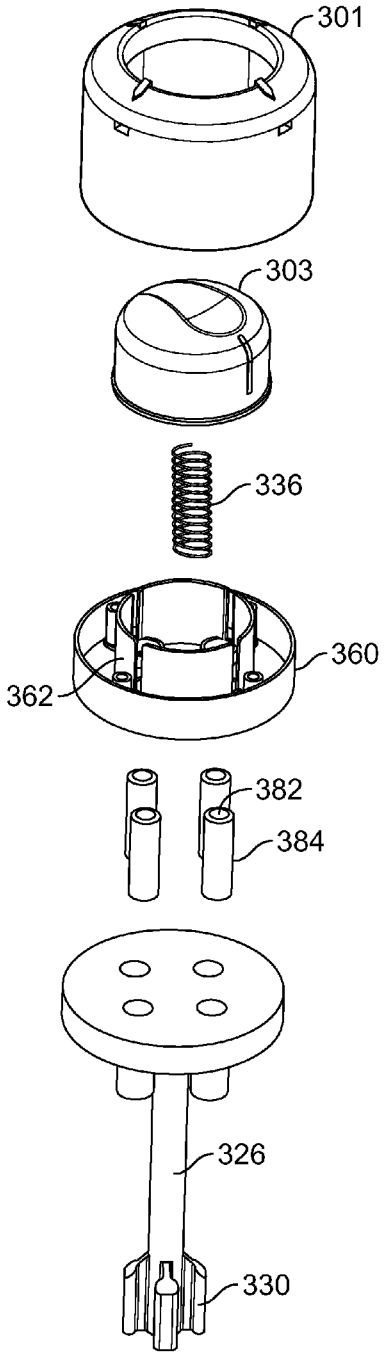
FIG. 38 shows an exploded view of the illustrative multi-chamber dispenser of FIG. 33 according to an embodiment of the invention.
Figure 41:
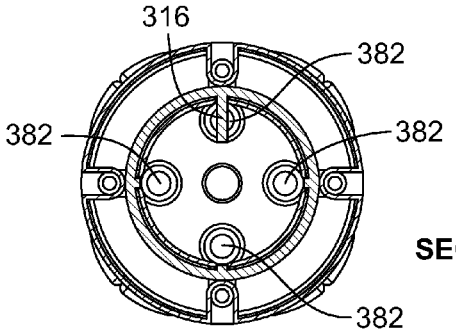
FIG. 41 shows a schematic cross-sectional view of the illustrative multi-chamber dispenser of FIG. 39, taken along line B-B, according to an embodiment of the invention.
Figure 39:
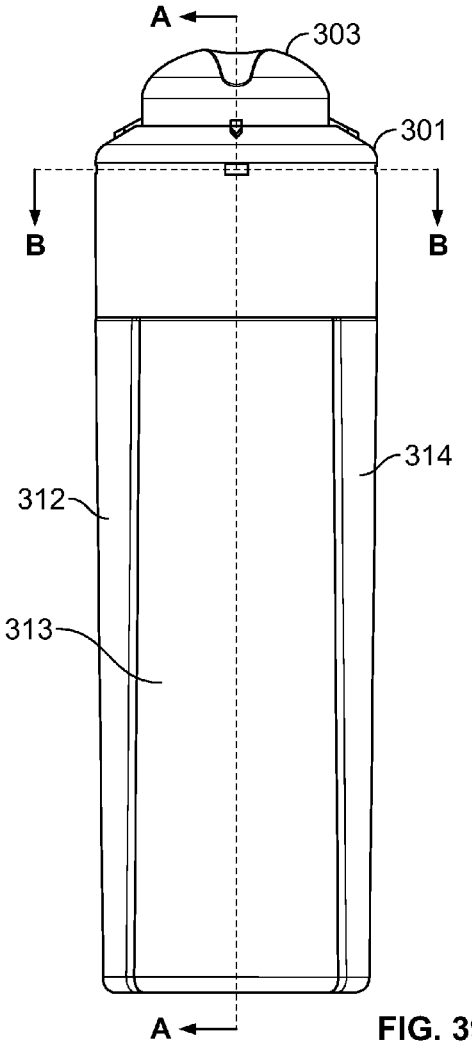
FIG. 39 shows a rear elevation view of the illustrative multi-chamber dispenser of FIG. 33 according to an embodiment of the invention.

FIG. 38 shows an exploded view of the illustrative multi-chamber dispenser of FIG. 33 according to an embodiment of the invention. As shown in FIG. 38, for example, cap 301 includes a bottom cap housing 360 that may be positioned to retain actuator 303 therein about a periphery of upright casing 362. Bottom cap housing 360 may be configured to allow actuator 303 to translate along upright casing 362 either upwards or downwards with resistance provided by spring 336. Spring 336 may bias actuator 303 in an upright position, for example, until actuator 303 is depressed.

Figure 40:
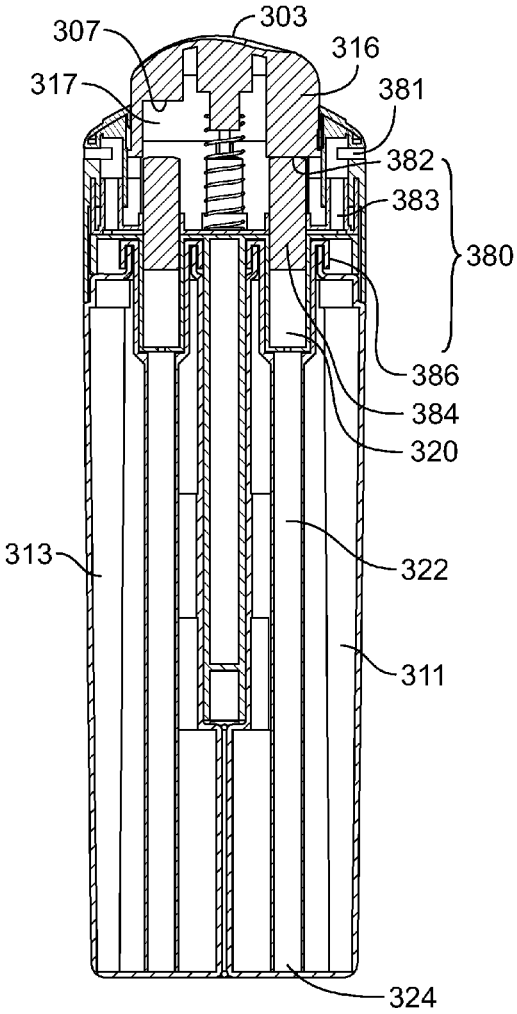
FIG. 40 shows a schematic cross-sectional view of the illustrative multi-chamber dispenser of FIG. 39, taken along line A-A, according to an embodiment of the invention.
Figure 44:
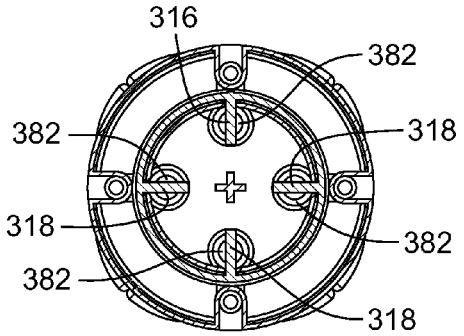
FIG. 44 shows a schematic cross-sectional view of the illustrative multi-chamber dispenser of FIG. 42, taken along line D-D, according to an embodiment of the invention.
Figure 42:
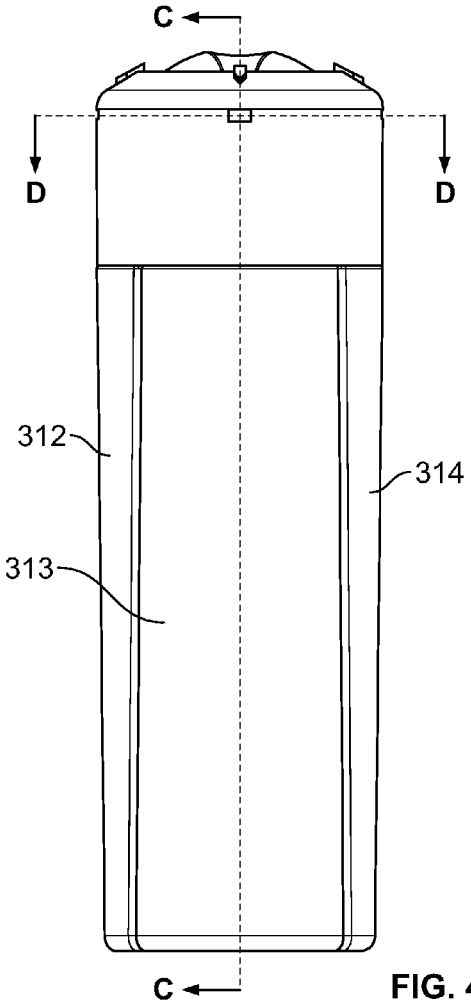
FIG. 42 shows a rear elevation view of the illustrative multi-chamber dispenser of FIG. 33 according to an embodiment of the invention.

Dispenser 300 may include one or more pumps attached to rigid frame 326, such as pump 380 of FIG. 40. It will be understood any suitable type of pump may be provided as discussed above in connection with pump 180 of FIG. 1. Pump 380 may include, for example, dispenser head 382 and piston or neck portion 384. Because pumps 380 may be provided with rigid frame 326 of dispenser 300 rather than with individual chambers 311-214, in some embodiments chambers 311-314 may not be operable to dispense a substance unless they are fastened to dispenser 300. However, in some embodiments, an external pump (e.g., external pump 270 of FIGS. 22 and 23) may be provided that may include a dispenser head 272, a piston or neck portion 274, and a nozzle 271. External pump 270 may be configured to removably attach to one of chambers 311-314 for operation thereof when that respective chamber is not fastened to dispenser 300.

A chamber may be selected and/or actuated according to various embodiments as shown in FIGS. 39-44. The interior of actuator 303 may include a selecting rib 316. First pump bottle or removable chamber 311 may be selected, for example, by rotating actuator 303 into a dispensing position whereby the selecting rib 316 may be aligned with dispenser head 382 that is proximate to first chamber 311. In this position, for example, front dispensing portion 306 may be substantially aligned with the outer surface of first chamber 311 (e.g., outer surface 390 of first chamber 311 of FIG. 37). The selecting rib 316 of actuator 303 may thus be configured to engage dispenser head 382 of pump 380.

Figure 43:
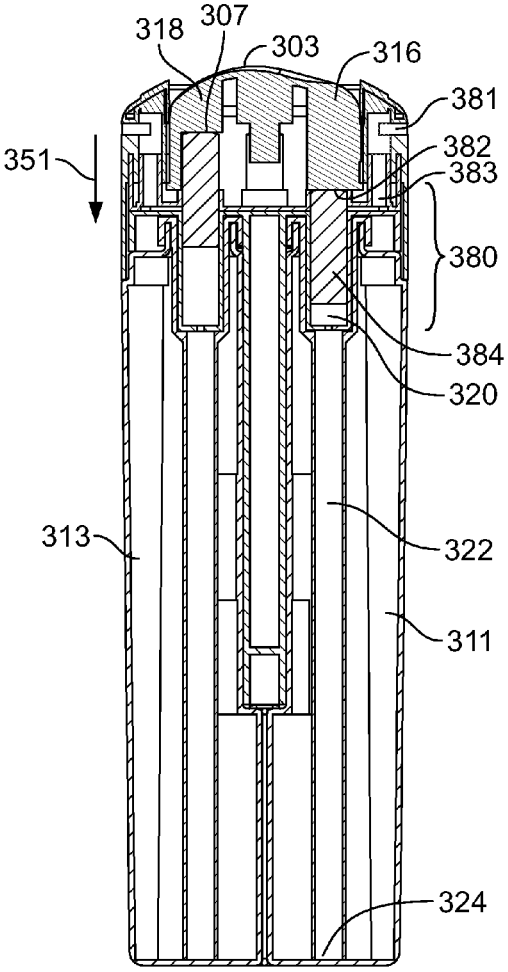
FIG. 43 shows a schematic cross-sectional view of the illustrative multi-chamber dispenser of FIG. 42, taken along line C-C, according to an embodiment of the invention.

Referring now to FIGS. 40 and 43, in order to dispense the substance or substances of selected chamber 311, actuator 303 may be pressed axially downwards (in the direction of arrow 351), thereby actuating pump 380 via dispenser head 382 that is engaged with the selecting rib 316, which each time pumps a quantity of fluid or other substance from at least one of removable chambers 311-314, the quantity of fluid or other substance determined by the internal and/or external characteristics of pump 380. For example, each depression of actuator 303, thereby actuating pump 380, may cause a preferred amount of substance to be expelled from within a dispensing chamber (e.g., dispensing chamber 311). Actuator 303 may translate downward towards chambers 311-314 until piston 384 is substantially fully depressed into pump chamber 320. As shown in FIG. 43, for example, actuating pump 380 via dispenser head 382 causes piston 384 to retract into pump chamber 320 (compared to the position of piston 384 in FIG. 40), thereby creating a negative pressure and drawing a substance out of chamber 311 via opening 324 of collecting tube 322. The substance may then pass through pump chamber 320, independent dispensing conduit 383, and out nozzle 381.

In some embodiments, one or more ridges may be provided that may provide tactile feedback as a user depresses actuator 303. For example, a ridge (not shown) may be provided on actuator 304 that may contact a reciprocal ridge on top cap portion 302. Actuator 303 may "click" as it passes each ridge, thereby informing a user, depending on the number of "clicks," approximately how much substance is being dispensed. It will be understood that for a given travel distance of actuator 303, each pump need not dispense the same quantity of substance from a respective chamber. For example, a plurality of chambers may be provided, each attached via rigid frame 326 to its respective pump, and the amount of substance dispensed may vary, for example, based on the type of substance within each chamber.

In some embodiments, actuator 303 may be configured to only select a single chamber. In some embodiments, actuator 303 may be configured to select more than one chamber. For example, selecting rib 316 of actuator 303 may be configured to align with the dispenser heads 382 of more than one chamber (not shown). In each of these embodiments, however, it will be understood that actuator 303 may substantially prevent the non-selected chambers from being actuated.

As shown in FIGS. 40 and 43, the clearance space 317 above non-selected chambers 312-314 may substantially prevent non-selected chambers 312-314 from being actuated. For example, when actuator 303 is in a substantially fully depressed position, the inside surface 307 of actuator 303 may contact or nearly contact the dispensing head of one or more of the non-selected chambers 312-314 without actuating the dispensing head, thereby preventing the substance or substances from the non-selected chambers from being dispensed. The clearance of clearance space 317 as shown in FIGS. 40 and 43 (e.g., the distance between the inside surface 307 of actuator 303 and a dispensing head, both before and after actuator 303 is depressed) is merely illustrative, and it will be understood that clearance space 317 may be any suitable distance that may prevent non-selected chambers (e.g., chambers 312-314) from being actuated when a selected chamber (e.g., chamber 311) is actuated.

As shown in FIG. 38, for example, dispenser 300 may include rigid frame 326 having bottle retention or docking dovetails 330. Docking dovetails 330 may be used for attaching one or more chambers 311-314 to dispenser 300 via the interlock portions 395 of the respective chambers 311-314 as previously described in connection with dispensers 100 and 200.

Figure 46:
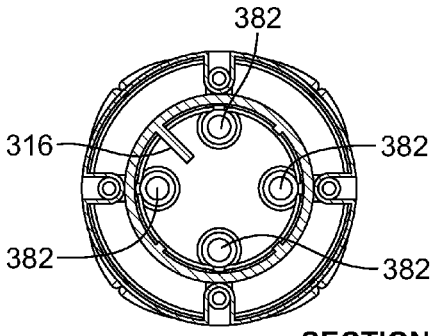
FIG. 46 shows a schematic cross-sectional view of the illustrative multi-chamber dispenser of FIG. 45, taken along line E-E, according to an embodiment of the invention.
Figure 48:
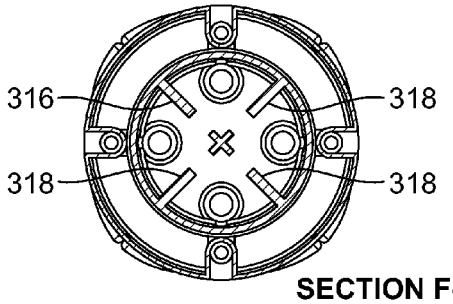
FIG. 48 shows a schematic cross-sectional view of the illustrative multi-chamber dispenser of FIG. 47, taken along line F-F, according to an embodiment of the invention.
Figure 45:
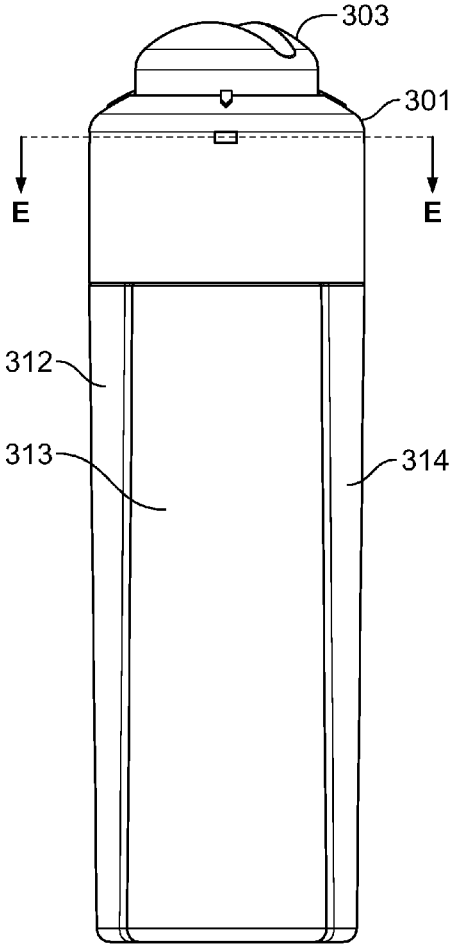
FIG. 45 shows a rear elevation view of the illustrative multi-chamber dispenser of FIG. 33 according to an embodiment of the invention.
Figure 47:
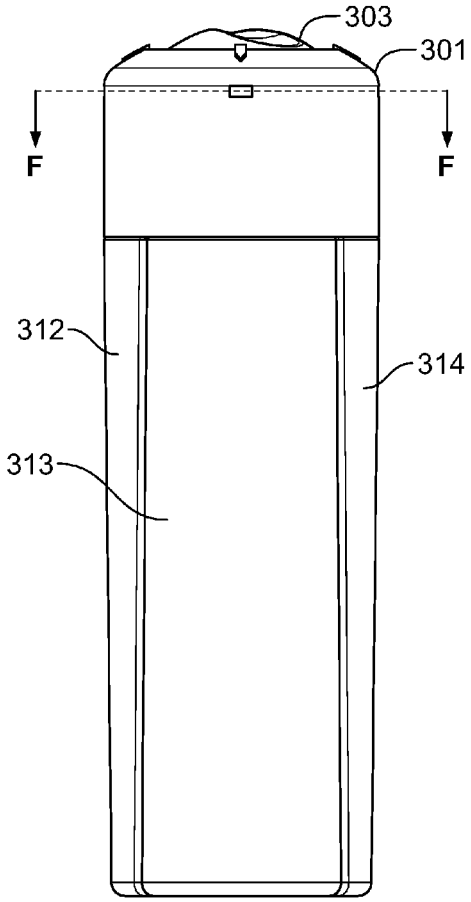
FIG. 47 shows a rear elevation view of the illustrative multi-chamber dispenser of FIG. 33 according to an embodiment of the invention.

There may be one or more lockout positions of dispenser 300 that may prevent a user from actuating any one of the one or more chambers 311-314 of dispenser 300. This may be useful, for example, when dispenser 300 is not being used. FIGS. 45-48 show various embodiments of dispenser 300 in a lockout position. For example, as shown in FIG. 46, the selecting rib 316 of actuator 303 does not touch any of dispenser heads 382. Thus, while actuator 303 may still be depressed and may travel downwards, actuator 303 may not actuate any of chambers 311-314. In this illustrative example, actuator 303 has been rotated 45-degrees counter-clockwise from the application position shown in FIG. 44.

Example 4

FIGS. 49-56 show various perspectives and cross-sections of an illustrative multi-chamber dispenser according to various embodiments of the present invention. Multi-chamber dispenser 400 may include one or more pump bottles or removable chambers 411-414 that may be removably fastened to a rigid frame of dispenser 400 (e.g., rigid frame 426 of FIG. 50). Although dispenser 400 is shown as having up to four removable chambers 411-414 it will be understood that any suitable number of removable chambers may be provided. Moreover, although each removable chamber 411-414 is shown as being substantially the same type (i.e., a pump bottle), it will be understood that any suitable type of removable chamber may be provided (e.g., various pump bottles and spray bottles or cartridges) in any suitable combination, and each chamber may contain any suitable respective substance or substances that may be dispensed by dispenser 400. Each of chambers 411-414 may contain the same substance or may contain different substances as any one or more of the other chambers.

A cap 401 may be positioned at a dispensing end of dispenser 400 and may include a top portion 402, a radial portion 404, and a rotatable button or actuator 403 having a front dispensing portion 406. Actuator 403 may be rotatable to various dispensing/application positions. For example, as shown in FIGS. 49-52, actuator 403 is rotated to an application position for first pump bottle or removable chamber 411. Dispenser 400 may be similar to dispenser 300 in that cap 401 may be stationary and actuator 403 may be rotatable to various dispensing/application positions. In some embodiments, a spring may be provided such as spring 436 of FIG. 51 that may bias actuator 403 in an upwards position.

Figure 49:
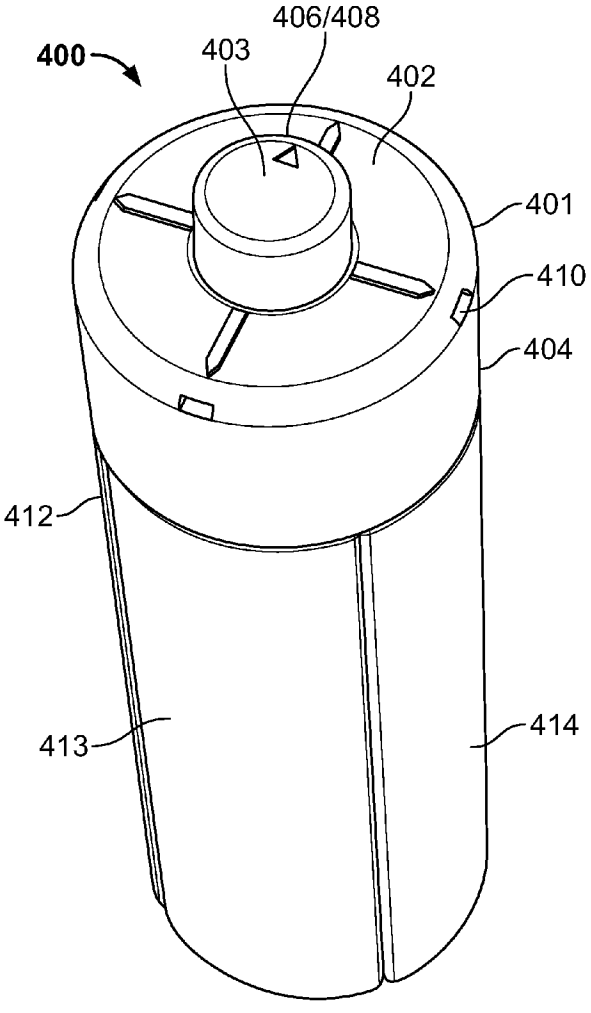
FIG. 49 shows a perspective view of an illustrative multi-chamber dispenser according to an embodiment of the invention.

Front dispensing portion 406 of actuator 403 may include a chamfer portion 408 that visually or tactually indicates the position of actuator 403 relative to each of the chambers 411-414. Cap 402 may include one or more dispensing outlets 410 about the radial cap surface 404, each corresponding to at least one of chambers 411-414, and each dispensing outlet 410 may be configured to dispense a substance therethrough. Although the cross-sectional area of outlets 410 is substantially rectangular, it may be any other suitable shape, and of any other suitable size, configured to allow a substance to pass therethrough. For example, the cross-sectional area of outlet 410 may be substantially rectangular, triangular, circular or elliptical, hexagonal, any other desired shape, or any combination thereof. Chamfer portion 408 may also have any suitable shape. For example, as shown in FIG. 49, chamfer portion 408 may be substantially triangular. However, chamfer portion 408 may have any suitable shape or indent that may be used, for example, to indicate the position of actuator 403 relative to each of chambers 411-414. In some embodiments, portion 408 may not be indented at all.

In some embodiments, chambers 411-414 of dispenser 400 may be substantially similar to chambers 311-314 of FIG. 37, for example, and the description of the chambers of dispenser 300 shall be used herein with respect to chambers 411-414 of dispenser 400.

Figure 51:
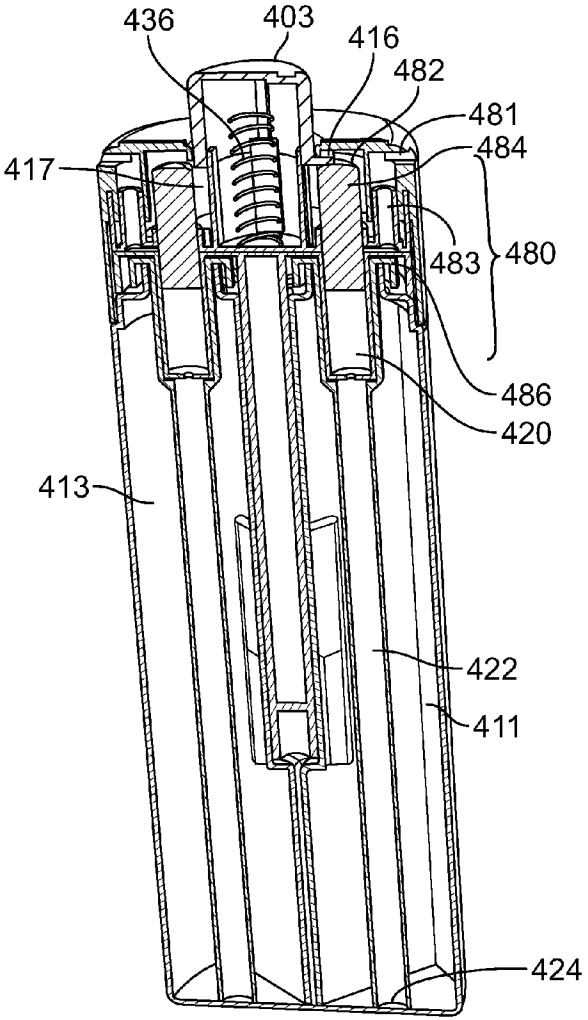
FIG. 51 shows a schematic cross-sectional view of the illustrative multi-chamber dispenser of FIG. 49 according to an embodiment of the invention.

Dispenser 400 may include one or more pumps attached to rigid frame 426, such as pump 480 of FIG. 51. It will be understood any suitable type of pump may be provided as discussed above in connection with pump 180 of FIG. 1. Pump 480 may include, for example, dispenser head 482 and piston or neck portion 484. Because pumps 480 may be provided with rigid frame 426 of dispenser 400 rather than with individual chambers 411-414, in some embodiments chambers 411-414 may not be operable to dispense a substance unless they are fastened to dispenser 400. However, in some embodiments, an external pump (e.g., external pump 270 of FIGS. 22 and 23) may be provided that may include a dispenser head 272, a piston or neck portion 274, and a nozzle 271. External pump 270 may be configured to removably attach to one of chambers 411-414 for operation thereof when that respective chamber is not fastened to dispenser 400.

A chamber may be selected and/or actuated according to various embodiments as shown in FIGS. 51-55. The interior of actuator 403 may include selecting ribs 416. First pump bottle or removable chamber 411 may be selected, for example, by rotating actuator 403 into a dispensing position whereby the selecting ribs 416 may be aligned with dispenser head 482 that is proximate to first chamber 411. In this position, for example, front dispensing portion 406 may be substantially aligned with the outer surface of first chamber 411 (e.g., outer surface 390 of first chamber 311 of FIG. 37). Selecting ribs 416 of actuator 403 may thus be configured to engage dispenser head 482 of pump 480 within rigid frame 426.

Figure 52:
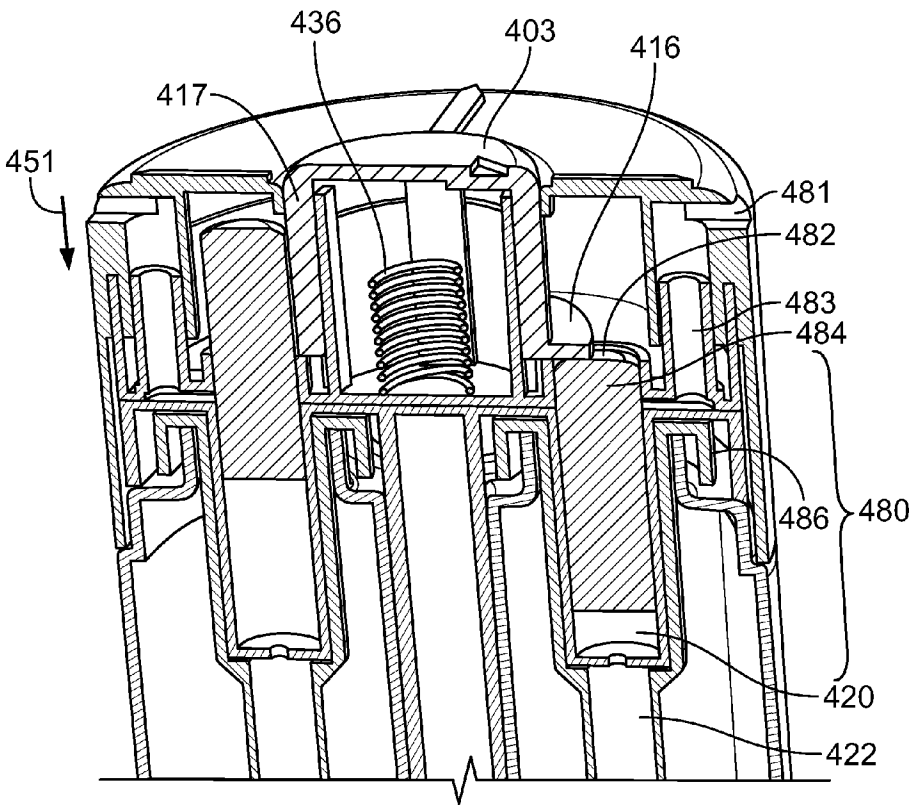
FIG. 52 shows a schematic cross-sectional view of the illustrative multi-chamber dispenser of FIG. 49 according to an embodiment of the invention.

Referring now to FIGS. 51 and 52, in order to dispense the substance or substances of selected chamber 411, actuator 403 may be pressed axially downwards (in the direction of arrow 451), thereby actuating pump 480 via dispenser head 482 that is engaged with the selecting ribs 416, which each time pumps a quantity of fluid or other substance from at least one of removable chambers 411-414, the quantity of fluid or other substance determined by the internal and/or external characteristics of pump 480. For example, each depression of actuator 403, thereby actuating pump 480, may cause a preferred amount of substance to be expelled from within a dispensing chamber (e.g., dispensing chamber 411). Actuator 403 may translate downward towards chambers 411-414 until piston 484 is substantially fully depressed into pump chamber 420. As shown in FIG. 52, for example, actuating pump 480 via dispenser head 482 causes piston 484 to retract into pump chamber 420 (compared to the position of piston 484 in FIG. 51), thereby creating a negative pressure and drawing a substance out of chamber 411 via opening 424 of collecting tube 422. The substance may then pass through pump chamber 420, independent dispensing conduit 483, and out nozzle 481.

In some embodiments, one or more ridges may be provided that may provide tactile feedback as a user depresses actuator 403. For example, a ridge (not shown) may be provided on actuator 404 that may contact a reciprocal ridge on top cap portion 402. Actuator 403 may "click" as it passes each ridge, thereby informing a user, depending on the number of "clicks," approximately how much substance is being dispensed. It will be understood that for a given travel distance of actuator 403, each pump need not dispense the same quantity of substance from a respective chamber. For example, a plurality of chambers may be provided, each attached via rigid frame 426 to its respective pump, and the amount of substance dispensed may vary, for example, based on the type of substance within each chamber.

In some embodiments, actuator 403 may be configured to only select a single chamber. In some embodiments, actuator 403 may be configured to select more than one chamber. For example, the selecting ribs 416 of actuator 403 may be configured to align with the dispenser heads 482 of more than one chamber (not shown). In each of these embodiments, however, it will be understood that actuator 403 may substantially prevent the non-selected chambers from being actuated.

Figure 54:
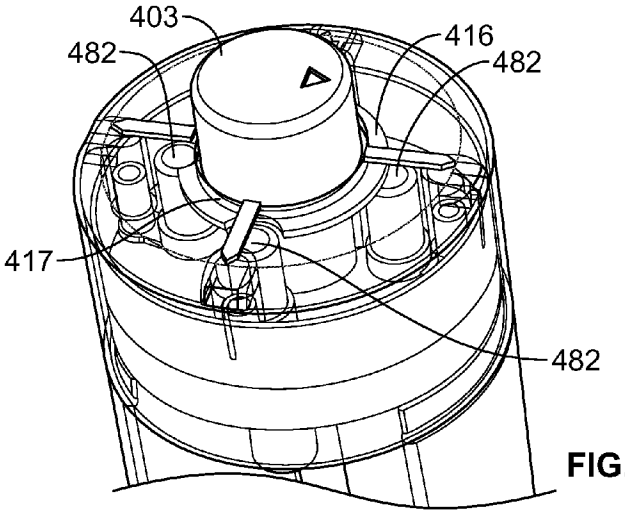
FIGS. 53-56 show sectional perspective views of the operation of the illustrative multi-chamber dispenser of FIG. 49 according to embodiments of the invention.
Figure 53:
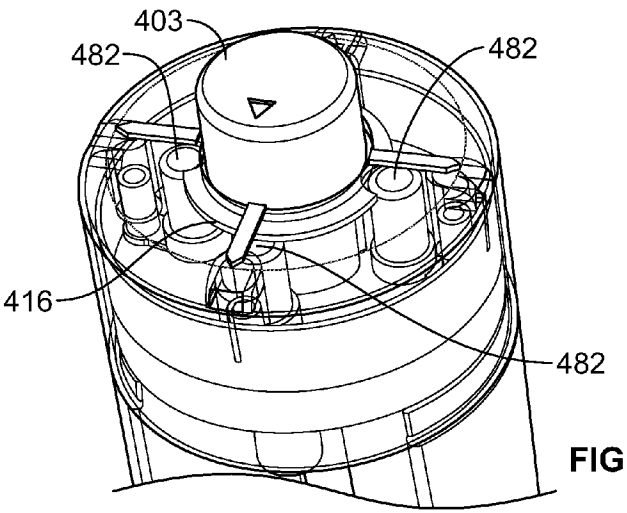

With continuing reference to FIGS. 51 and 52, clearance notches 417 may be cut into the selecting rib 416 of actuator 403 and may substantially encircle the non-selected chambers 412-414. The clearance notches 417 may substantially prevent non-selected chambers 412-414 from being actuated. For example, when actuator 403 is in a substantially fully depressed position, the clearance notches 417 of actuator 403 may substantially encircle the dispensing head of one or more of the non-selected chambers 412-414 without actuating the dispensing head, thereby preventing the substance or substances from the non-selected chambers from being dispensed. The clearance of clearance notches 417 as shown in FIGS. 53 and 54 (e.g., the cut-out area from the lip of the selecting ribs 416) is merely illustrative, and it will be understood that clearance notches 417 may be any suitable area that may prevent non-selected chambers (e.g., chambers 412-414) from being actuated when a selected chamber (e.g., chamber 411) is actuated.

Figure 50:
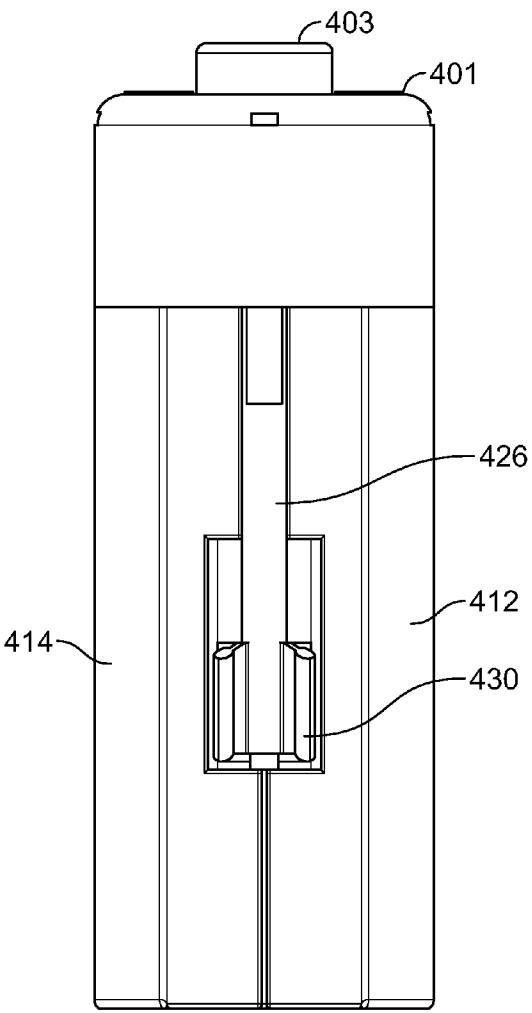
FIG. 50 shows a side elevation view of the illustrative multi-chamber dispenser of FIG. 49 according to an embodiment of the invention.

As shown in FIG. 50, for example, dispenser 400 may include rigid frame 426 having bottle retention or docking dovetails 430. Docking dovetails 430 may be used for attaching one or more chambers 411-414 to dispenser 400 via the interlock portions of the respective chambers 411-414 as previously described in connection with any of dispensers 100, 200, and 300.

Figure 56:
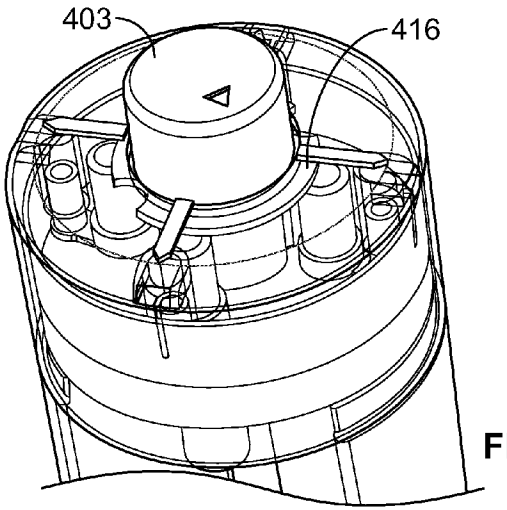
Figure 55:
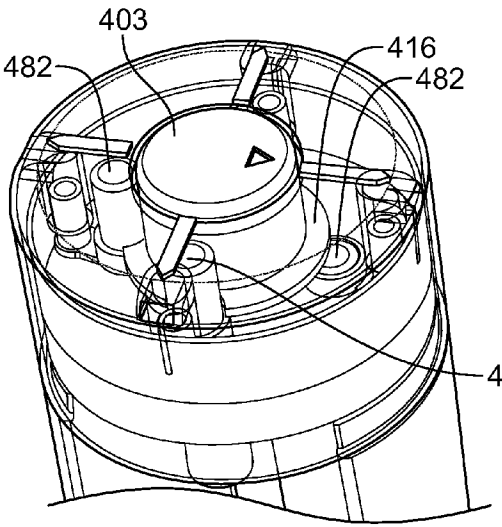
Figure 58:
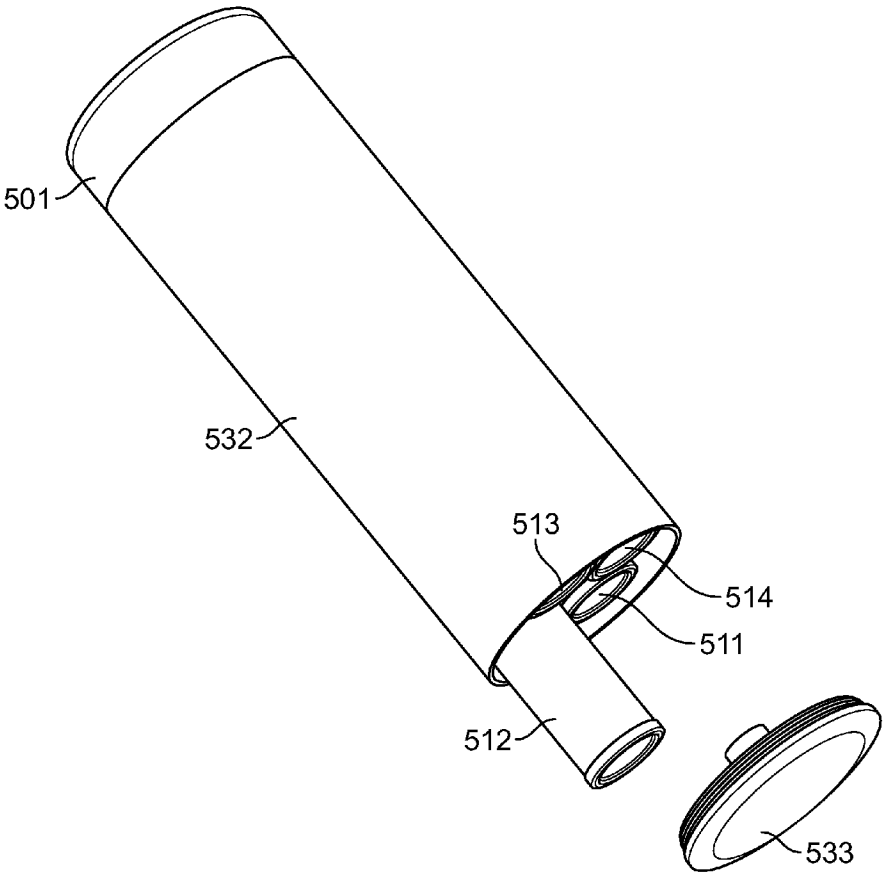
FIG. 58 shows a bottom perspective view of the illustrative multi-chamber dispenser of FIG. 57 according to an embodiment of the invention.
Figure 57:
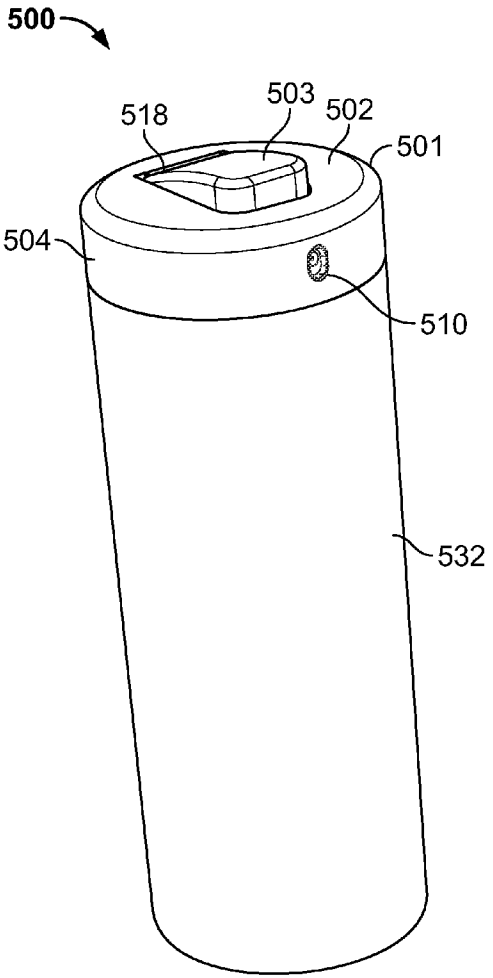
FIG. 57 shows a perspective view of an illustrative multi-chamber dispenser according to an embodiment of the invention.

There may be one or more lockout positions of dispenser 400 that may prevent a user from actuating any one of the one or more chambers 411-414 of dispenser 400. This may be useful, for example, when dispenser 400 is not being used. FIG. 56 shows dispenser 400 in a lockout position according to an embodiment of the present invention. For example, as shown in FIG. 56, the selecting rib 416 of actuator 403 may abut each of dispenser heads 484. In this illustrative example, actuator 403 has been rotated 45-degrees clockwise from the application position shown in FIGS. 54 and 55.

Example 5

FIGS. 57-66 show various perspectives and cross-sections of an illustrative multi-chamber spray dispenser according to various embodiments of the present invention. Multi-chamber dispenser 500 may include one or more spray bottles/cartridges or removable chambers 511-514 that may be removably fastened to a rigid frame of dispenser 500 (e.g., rigid frame 526 of FIG. 61). A housing 532 may substantially enclose the one or more removable chambers attached to dispenser 500. Housing 532 of dispenser 500 may therefore provide an interface by which a user may hold and/or operate dispenser 500 and may be configured for grasping thereof by a user's hand. In some embodiments, for example, housing 532 may be textured to increase the friction between housing 532 and a user's hand. Alternatively or additionally, in some embodiments housing 532 may be covered or wrapped with an elastic or flexible material including various rubbers, polymers, nylons, or any other suitable elastic or flexible material, or combinations thereof that may increase the friction between housing 532 and a user's palm. It will be understood that in some embodiments materials may be chosen without regard, or with relatively less regard, to friction.

In some embodiments, a housing end cap 533 may be provided at the bottom of dispenser 500 and may be configured to seal or substantially seal chambers 511-514 within housing 532. For example, housing end cap 533 may be provided with screw threads designed to mate with complementary internal threads on the bottom lip of housing 532, although any other suitable technique for fastening housing end cap 533 to housing 532 may be used. It will be understood that in some embodiments, no housing end cap 533 may be provided and chambers 511-514 may therefore be viewable through the bottom of housing 532. Further, in some embodiments, there may be no opening at the bottom of housing 532 (not shown) and chambers 511-514 may therefore be sealed or substantially sealed within housing 532 without the need to provide a housing end cap such as housing end cap 533.

Although dispenser 500 is shown as having up to four removable chambers 511-514, it will be understood that any suitable number of removable chambers may be provided. Moreover, although each removable chamber 511-514 is shown as being substantially the same type (i.e., a spray bottle), it will be understood that any suitable type of removable chamber may be provided (e.g., various pump bottles and spray bottles or cartridges) in any suitable combination, and each chamber may contain any suitable respective substance or substances that may be dispensed by dispenser 500. Each of chambers 511-514 may contain the same substance or may contain different substances as any one or more of the other chambers.

Figure 62:
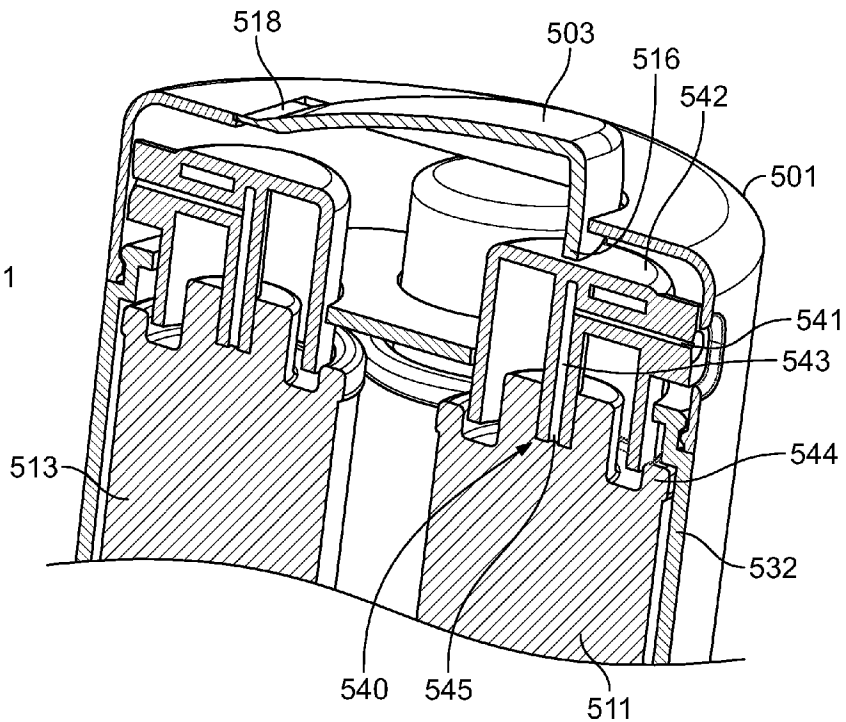
FIG. 62 shows a schematic cross-sectional view of the illustrative multi-chamber dispenser of FIG. 57 according to an embodiment of the invention.
Figure 61:
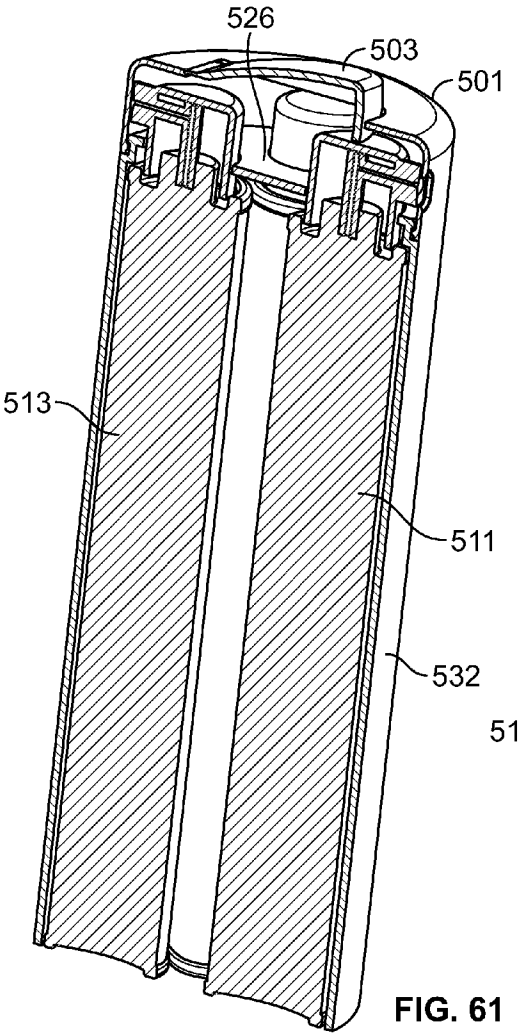
FIG. 61 shows a schematic cross-sectional view of the illustrative multi-chamber dispenser of FIG. 57 according to an embodiment of the invention.

A cap 501 may be positioned at a dispensing end of dispenser 500 and may include a top portion 502, a radial portion 504, a front dispensing portion having slot 510, and a button or actuator 503 with a living hinge 518. Cap 501 may be rotatable to various dispensing/application positions. For example, as shown in FIGS. 61 and 62, cap 501 is rotated to an application position for first spray bottle or removable chamber 511. Slot 510 may be configured to allow a dispenser head, such as dispenser head 542 of FIG. 59, to dispense a substance from a selected chamber therethrough. Although the cross-sectional area of slot 510 is substantially oval-shaped, it may be any other suitable shape, and of any other suitable size, configured to allow a dispenser head to dispense a substance therethrough. For example, the cross-sectional area of slot 510 may be substantially rectangular, triangular, circular or elliptical, hexagonal, any other desired shape, or any combination thereof.

Figure 60:
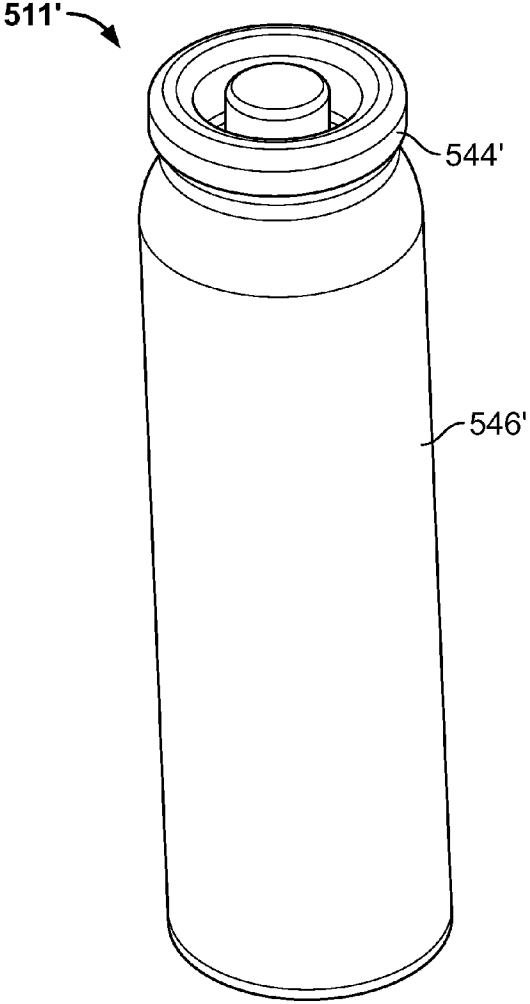
FIGS. 59 and 60 show perspective views of illustrative removable canisters according to embodiments of the invention.
Figure 59:
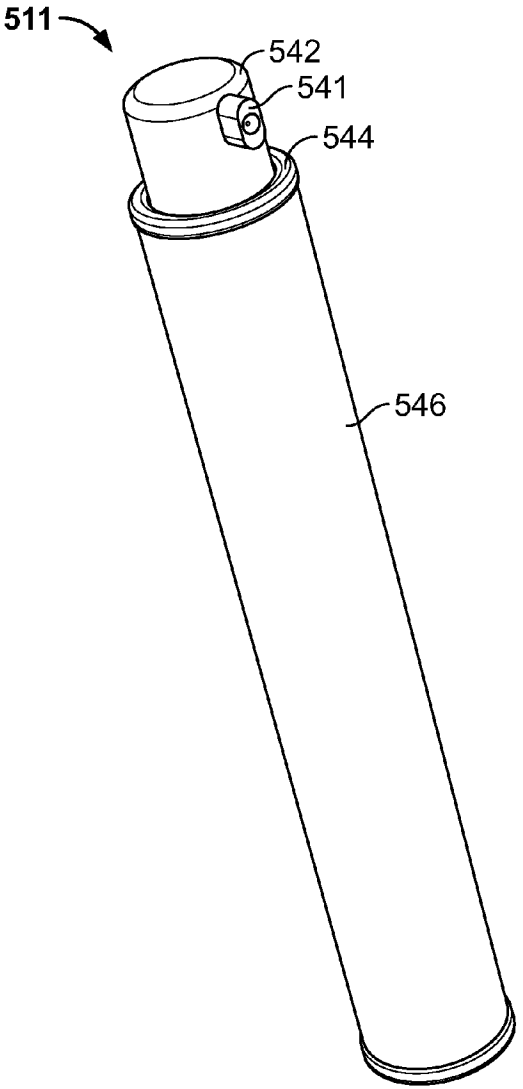

FIG. 59 shows a perspective view of first spray bottle or removable chamber 511 according to an embodiment of the invention. Chamber 511 may include, for example, dispenser head 542, spray nozzle 541, cylindrical sleeve 544, and spray canister housing 546. Chamber 511 may have a "tube with cap construction," where spray head 542 may be permanently attached thereto. For example, in some embodiments, chamber 511 may be independently operable even when not placed in a dispenser. The height/diameter aspect ratio of chamber 511 is theoretically unlimited, although certain aspect ratios may be relatively limiting due to price. FIG. 60 shows a perspective view of spray bottle or removable chamber 511' according to an embodiment of the invention. Chamber 511' may include cylindrical sleeve 544' and spray canister housing 546'. A dispenser head (not shown) may or may not be provided. Chamber 511' may have a relatively greater diameter than chamber 511, and may have a height/diameter ratio of approximately 3.2-to-1, for example. The greater diameter of chamber 511' may allow a relatively greater amount of substance to be placed in chamber 511' than chamber 511 relative to the amount of materials used to construct chamber 511'. In some embodiments, chamber 511' may be provided in a dispenser that may only receive a single chamber. In some embodiments, chamber 511' may be one of a plurality of chambers that may be provided in a dispenser. Thus, the dispensers of the present invention may have any suitable diameter that may be configured to allow various chambers to be removably fastened therein.

An aerosol spray valve 540 may be fitted or crimped within chamber 511, for example, as shown in FIG. 61. Spray valve 540 may be biased upwards using a spring (not shown), any other suitable technique, or any combination thereof, which may substantially block the dispensing conduit inlet 545, for example, via a sealing ring or gasket proximate inlet 545. When spray valve 540 is actuated, for example, inlet 545 may slide below the sealing ring or gasket, thereby opening a passage from the inside of chamber 511 to the outside of chamber 511 through which the substance or product may be dispensed. The relatively high-pressure propellant may drive the product up a collecting tube and out of the chamber via dispensing conduit inlet 545, dispensing conduit 543, and nozzle 541. Nozzle 541 may atomize the flowing fluids by breaking them up into relatively small particles which may form a fine spray or mist. In some embodiments a dust cap (not shown) may be placed on top of the dispensing head 542 to prevent particulates from collecting around nozzle 541 and interfering with the dispensing properties of the chamber. The consistency of the expelled product may depend on several factors including, but not limited to, the chemical makeup of the propellant and product, the ratio of propellant to product, the pressure of the propellant, and the size and shape of the valve system. It will be understood that the spray chambers of the present invention may have any suitable product/propellant in any number of chambers that may be suitable for dispensing said products.

The contents within chamber 511 may include the substance, or product, in the form of a liquid, emulsion, suspension, any other suitable fluid, or combinations thereof; and the propellant, which may be a liquefied gas, a compressed gas, any other suitable fluid, or combinations thereof. Any suitable propellant or propellants may be used including, but not limited to, liquefied petroleum gas (LPG), Dimethyl Ether, chlorofluorocarbons (CFC's), non-soluble compressed gases (e.g., compressed air and nitrogen), soluble compressed gases (e.g., carbon dioxide), any other suitable propellant, or combinations thereof.

It will be understood that the foregoing discussion of an illustrative spray chamber is merely exemplary, and various modifications may be made, for example, to the spray valve. For example, the spray valve may be modified depending on the type of substance to be dispensed and whether the propellant is liquefied gas or compressed gas. Moreover, it will be understood that any suitable type of spray valve may be provided with a dispenser.

A spray valve of the present invention may be operable regardless of whether the dispenser is placed upright, inverted, or on its side, or in any other suitable orientation. Alternatively, a spray valve of the present invention may be configured to operate only in a certain orientation or orientations. For example, in some embodiments it may be desirable to only allow the spray valve to operate in a preferred orientation. Moreover, the dispenser of the present invention may be operable when less than all of the chambers are fastened to the dispenser. For example, in a dispenser configured to receive four chambers, the dispenser may be operable when less than all of the four chambers are fastened to the rigid frame.

In some embodiments, spray head 542 may be permanently attached to removable chamber 511, and removable chamber 511 may be operated independently of dispenser 500. Spray canister housing 546 of chamber 511 may therefore provide an interface by which a user may hold and/or operate chamber 511 and may be configured for grasping thereof by a user's hand. In some embodiments, for example, spray canister housing 546 may be textured to increase the friction between housing 546 and a user's hand. Alternatively or additionally, in some embodiments spray canister housing 546 may be covered or wrapped with an elastic or flexible material including various rubbers, polymers, nylons, or any other suitable elastic or flexible material, or combinations thereof that may increase the friction between spray canister housing 546 and a user's palm. It will be understood that in some embodiments materials may be chosen without regard, or with relatively less regard, to friction.

A chamber may be selected and/or actuated according to various embodiments as shown in FIGS. 61-65. The interior of cap 501 may include a selecting rib 516 of actuator 503. The user may select chamber 511, for example, by rotating cap 501 into an application position (whereby the selecting rib 516 may be aligned with dispenser head 542 proximate to first chamber 511) and pressing or actuating actuator 503 axially downwards, which each time sprays a quantity of fluid or other substance from at least one of removable chambers 511-514, the quantity of fluid or other substance determined by the internal and/or external characteristics of the respective chamber. For example, each depression of actuator 503, thereby actuating dispenser head 542 of chamber 511, may cause a preferred amount of substance to be expelled from within a dispensing chamber (e.g., dispensing chamber 511).

Figure 64:
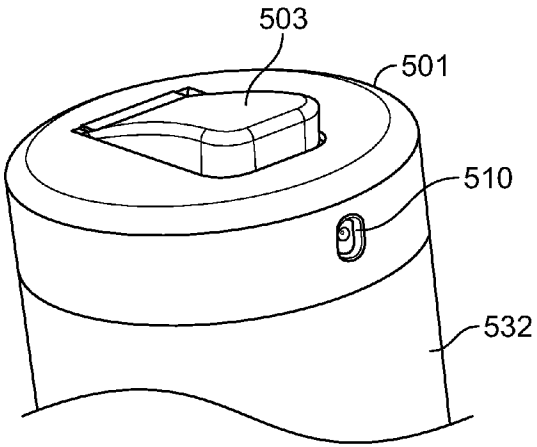
FIGS. 63-65 show perspective views of the operation of the illustrative multi-chamber dispenser of FIG. 57 according to embodiments of the invention.
Figure 63:
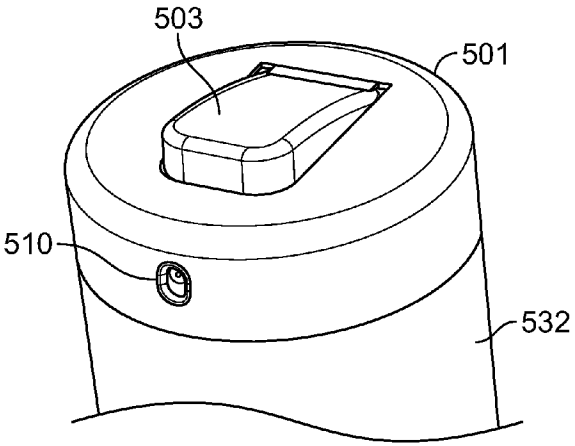
Figure 65:
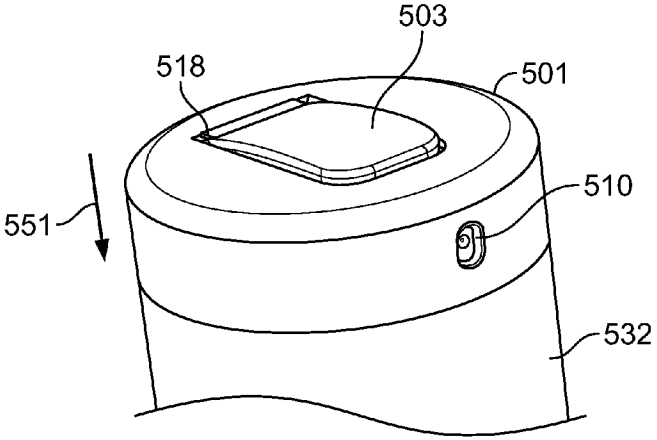
Figure 68:
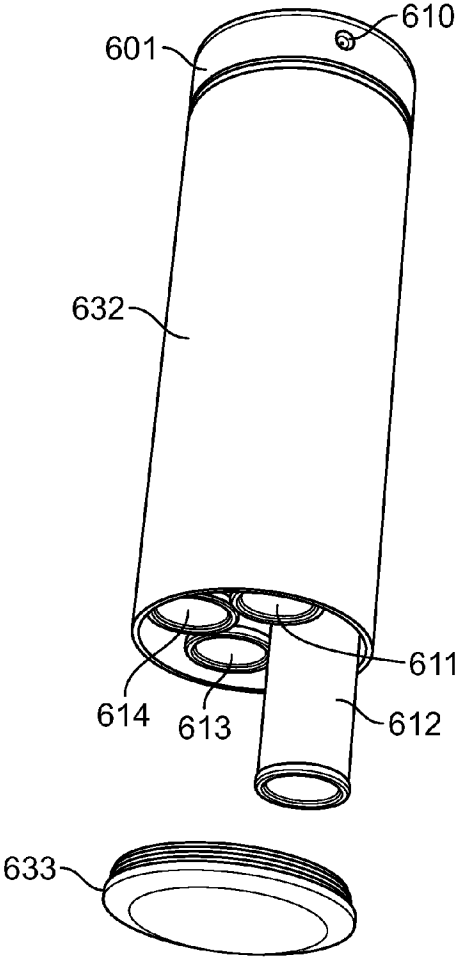
FIG. 68 shows a bottom perspective view of the illustrative multi-chamber dispenser of FIG. 67 according to an embodiment of the invention.
Figure 67:
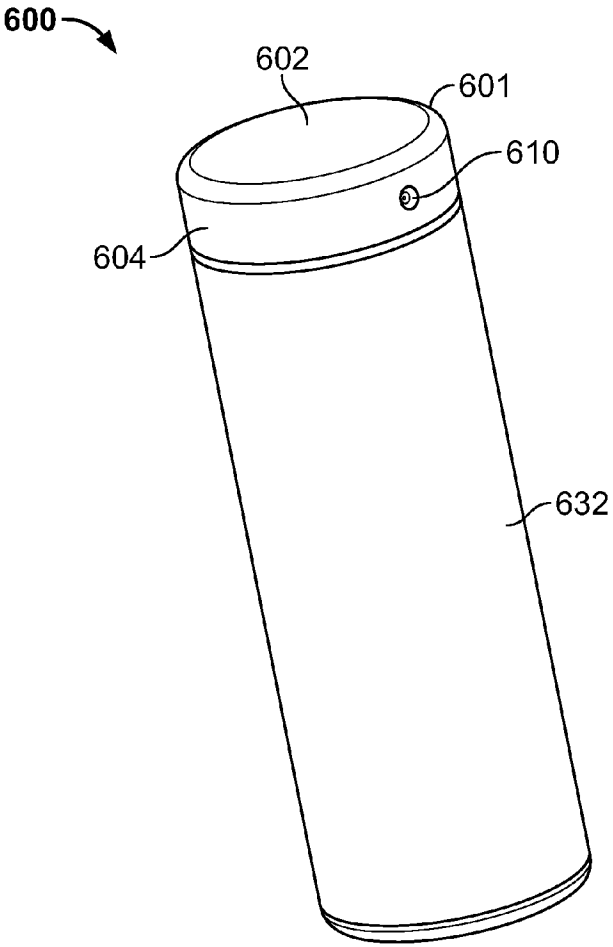
FIG. 67 shows a perspective view of an illustrative multi-chamber dispenser according to an embodiment of the invention.

As shown in FIGS. 64 and 65, for example, in order to dispense the substance or substances of selected chamber 511, actuator 503 may be pressed axially downwards (in the direction of arrow 551), thereby actuating dispenser head 542 that is engaged with the selecting rib 516. Actuator 503 may translate downward towards chambers 511-514 until dispenser head 542 is substantially fully depressed. This may actuate a spray valve within selected chamber 511 and cause the contents of chamber 511 to be dispensed, for example, as described above in connection with spray valve 540 of FIG. 61.

In some embodiments, one or more ridges may be provided that may provide tactile feedback as a user depresses actuator 503. For example, a ridge (not shown) may be provided on actuator 503 that may contact a reciprocal ridge on the interior of top cap portion 502. Actuator 503 may "click" as it passes each ridge, thereby informing a user, depending on the number of "clicks," approximately how much substance is being dispensed. It will be understood that for a given travel distance of actuator 503, each chamber need not dispense the same quantity of substance. For example, a plurality of chamber may be provided, each attached to rigid frame 526 via its respective cylindrical sleeves 544, and the amount of substance dispensed may vary, for example, based on the type of substance within each chamber.

In some embodiments, actuator 503 may be configured to only select a single chamber. In some embodiments, actuator 503 may be configured to select more than one chamber. For example, the selecting rib 516 of actuator 503 may be configured to align with the dispenser heads 542 of more than one chamber (not shown). In each of these embodiments, however, it will be understood that actuator 503 may substantially prevent the non-selected chambers from being actuated.

Figure 66:
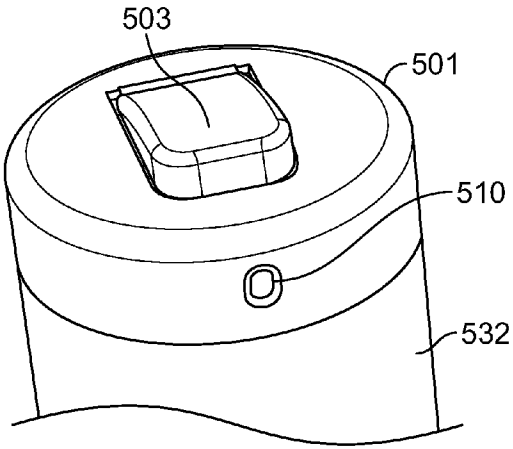
FIG. 66 shows a perspective view of the illustrative multi-chamber dispenser of FIG. 57 according to an embodiment of the invention.

There may be one or more lockout positions of dispenser 500 that may prevent a user from actuating any one of the one or more chambers 511-514 of dispenser 500. FIG. 66 shows an embodiment of illustrative dispenser 500 in a lockout position. The spray nozzle of any one of chambers 511-514 may be substantially sealed by radial portion 504 of cap 501. For example, as shown in FIG. 66, cap 501 is rotated such that no spray nozzle is aligned with slot 510. Moreover, the selecting rib 516 of actuator 503 may not touch any of dispenser heads 542. Thus, while actuator 503 may still be depressed and may travel downwards, actuator 503 may not actuate any of chambers 511-514. In this illustrative example, cap 501 has been rotated 45-degrees clockwise from the application position shown in FIG. 65.

Example 6

FIGS. 67-74 show various perspectives and cross-sections of an illustrative multi-chamber spray dispenser according to various embodiments of the present invention. Multi-chamber dispenser 600 may include one or more spray bottles/cartridges or removable chambers 611-614 that may be removably fastened to a rigid frame of dispenser 600 (e.g., rigid frame 626 of FIG. 69). A housing 632 may substantially enclose the one or more removable chambers attached to dispenser 600. Housing 632 of dispenser 600 may therefore provide an interface by which a user may hold and/or operate dispenser 600 and may be configured for grasping thereof by a user's hand. In some embodiments, for example, housing 632 may be textured to increase the friction between housing 632 and a user's hand. Alternatively or additionally, in some embodiments housing 632 may be covered or wrapped with an elastic or flexible material including various rubbers, polymers, nylons, or any other suitable elastic or flexible material, or combinations thereof that may increase the friction between housing 632 and a user's palm. It will be understood that in some embodiments materials may be chosen without regard, or with relatively less regard, to friction.

In some embodiments, a housing end cap 633 may be provided at the bottom of dispenser 600 and may be configured to seal or substantially seal chambers 611-614 within housing 632. For example, housing end cap 633 may be provided with screw threads designed to mate with complementary internal threads on the bottom lip of housing 632, although any other suitable technique for fastening housing end cap 633 to housing 632 may be used. It will be understood that in some embodiments, no housing end cap 633 may be provided and chambers 611-614 may therefore be viewable through the bottom of housing 632. Further, in some embodiments, there may be no opening at the bottom of housing 632 (not shown) and chambers 611-614 may therefore be sealed or substantially sealed within housing 632 without the need to provide a housing end cap such as housing end cap 633.

Although dispenser 600 is shown as having up to four removable chambers 611-614, it will be understood that any suitable number of removable chambers may be provided. Moreover, although each removable chamber 611-614 is shown as being substantially the same type (i.e., a spray bottle), it will be understood that any suitable type of removable chamber may be provided (e.g., various pump bottles and spray bottles or cartridges) in any suitable combination, and each chamber may contain any suitable respective substance or substances that may be dispensed by dispenser 600. Each of chambers 611-614 may contain the same substance or may contain different substances as any one or more of the other chambers.

Figure 69:
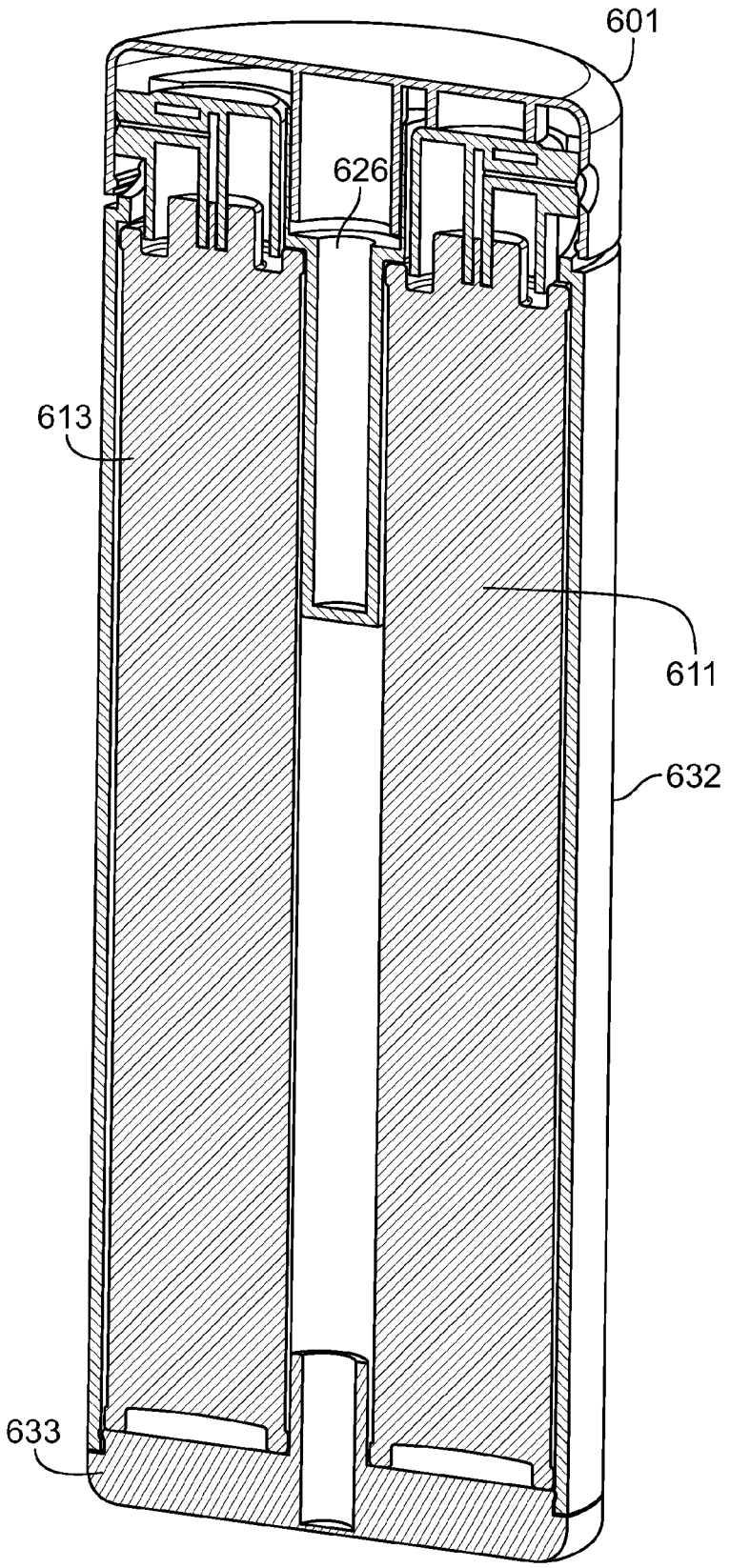
FIG. 69 shows a schematic cross-sectional view of the illustrative multi-chamber dispenser of FIG. 67 according to an embodiment of the invention.
Figure 70:
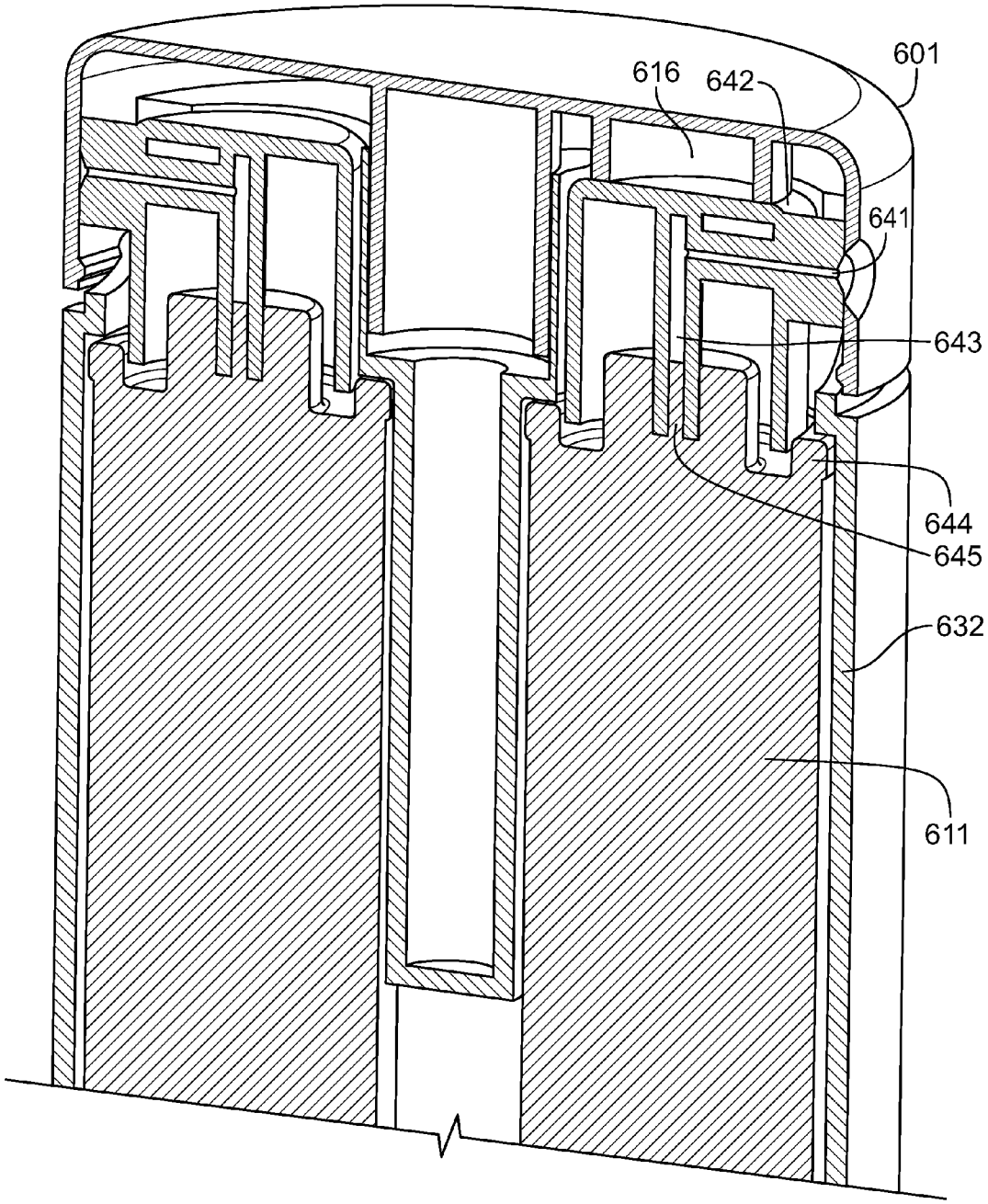
FIG. 70 shows a schematic cross-sectional view of the illustrative multi-chamber dispenser of FIG. 67 according to an embodiment of the invention.

A cap 601 may be positioned at a dispensing end of dispenser 600 and may include a top portion 602, a radial portion 604, and a front dispensing portion having slot 610. In some embodiments, a tactile element 608 (FIGS. 71-74) may be provided on cap 601 that may indicate to a user the direction in which a substance may be dispensed. Cap 601 may be rotatable to various dispensing/application positions. For example, as shown in FIGS. 69 and 70, cap 601 is rotated to an application position for first spray bottle or removable chamber 611. Slot 610 may be configured to allow a dispenser head, such as dispenser head 642 of FIG. 70, to dispense a substance from a selected chamber therethrough. Although the cross-sectional area of slot 610 is substantially circular, it may be any other suitable shape, and of any other suitable size, configured to allow a dispenser head to dispense a substance therethrough. For example, the cross-sectional area of slot 610 may be substantially rectangular, triangular, circular or elliptical, hexagonal, any other desired shape, or any combination thereof.

A chamber may be selected and/or actuated according to various embodiments as shown in FIGS. 69-73. The interior of cap 601 may include a selecting rib 616. The user may select chamber 611, for example, by rotating cap 601 into an application position (whereby the selecting rib 616 may be aligned with dispenser head 642 proximate to first chamber 611) and pressing or actuating cap 601 axially downwards, which each time sprays a quantity of fluid or other substance from at least one of removable chambers 611-614, the quantity of fluid or other substance determined by the internal and/or external characteristics of the respective chamber. For example, each depression of cap 601, thereby actuating dispenser head 642 of chamber 611, may cause a preferred amount of substance to be expelled from within a dispensing chamber (e.g., dispensing chamber 511).

Figure 72:
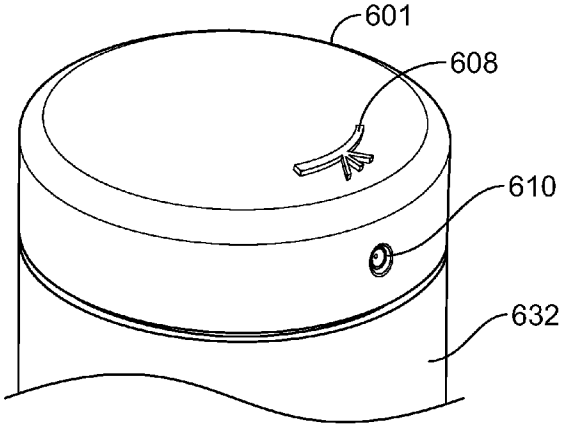
FIGS. 71-73 show perspective views of the operation of the illustrative multi-chamber dispenser of FIG. 67 according to embodiments of the invention.
Figure 71:
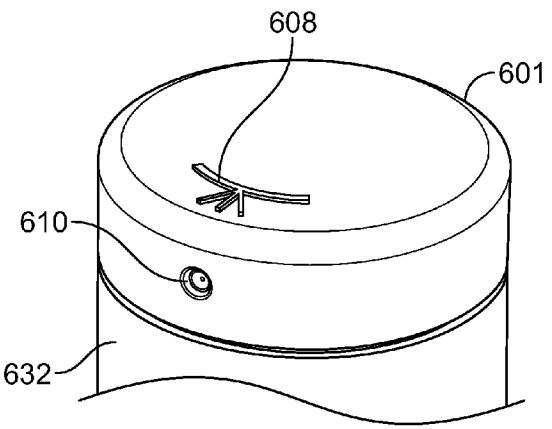
Figure 73:
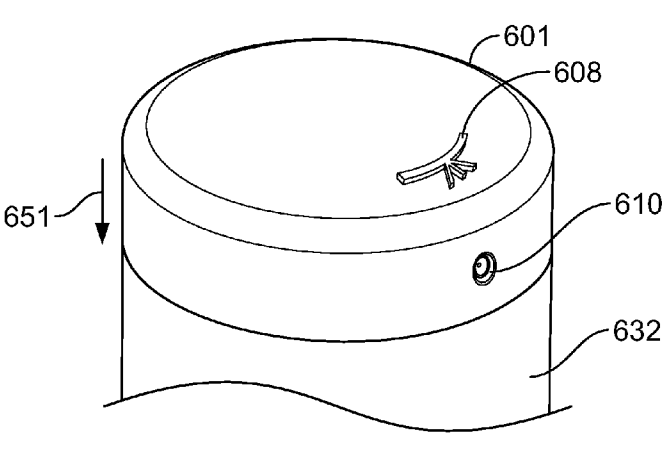
Figure 75:
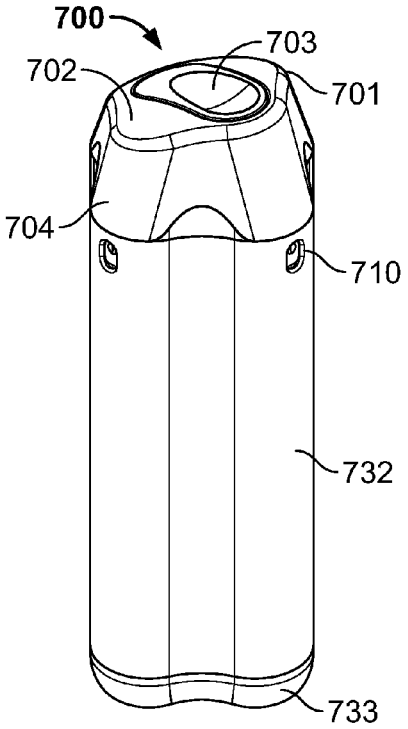
FIG. 75 shows a perspective view of an illustrative multi-chamber dispenser according to an embodiment of the invention.
Figure 76:
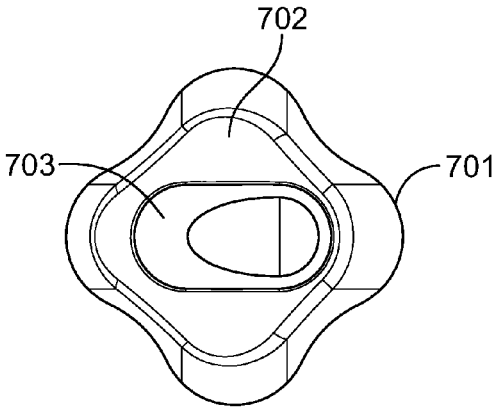
FIG. 76 shows a top plan view of the illustrative multi-chamber dispenser of FIG. 75 according to an embodiment of the invention.
Figure 77:
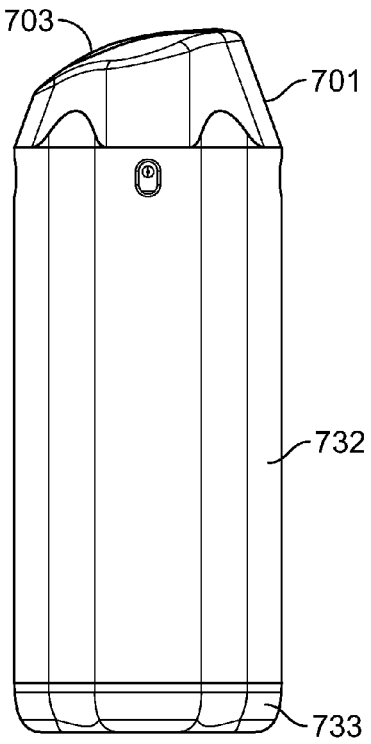
FIGS. 77 and 78 show a side and a front elevation view, respectively, of the illustrative multi-chamber dispenser of FIG. 75 according to embodiments of the invention.
Figure 78:
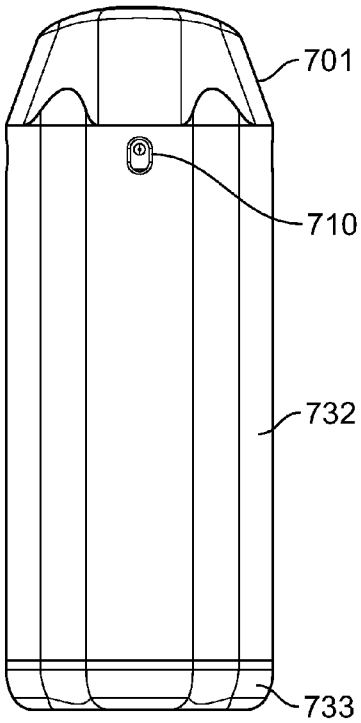
Figure 80:
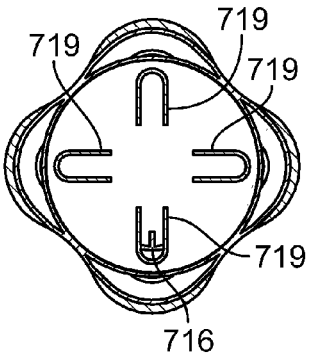
FIG. 80 shows a schematic cross-sectional view of the illustrative multi-chamber dispenser of FIG. 79, taken along line A-A, according to an embodiment of the invention.
Figure 79:
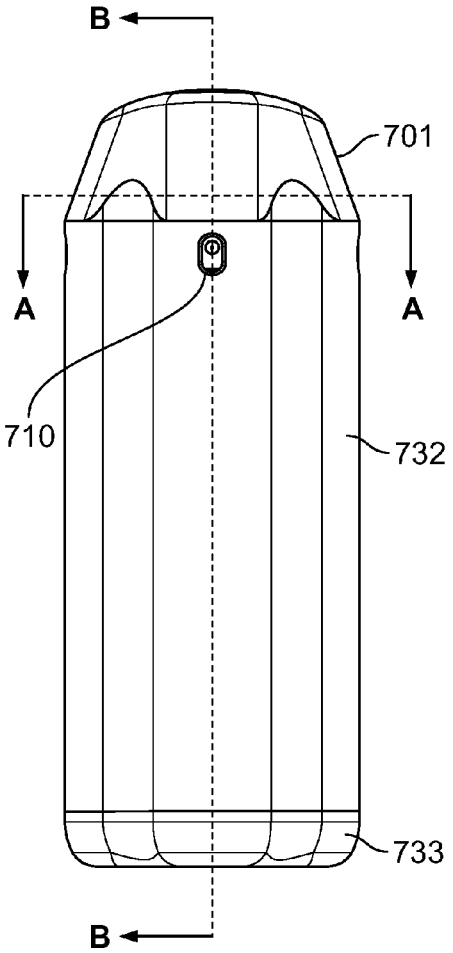
FIG. 79 shows a front elevation view of the illustrative multi-chamber dispenser of FIG. 75 according to an embodiment of the invention.

As shown in FIGS. 72 and 73, for example, in order to dispense the substance or substances of selected chamber 611, cap 601 may be pressed axially downwards (in the direction of arrow 651), thereby actuating dispenser head 642 that is engaged with the selecting rib 616. Cap 601 may translate downward towards chambers 611-614 until dispenser head 642 is substantially fully depressed. This may actuate a spray valve within selected chamber 611 and cause the contents of chamber 611 to be dispensed via dispensing conduit inlet 645, dispensing conduit 643, and nozzle 641, for example, as described above in connection with spray valve 540 of FIG. 61.

In some embodiments, one or more ridges may be provided that may provide tactile feedback as a user depresses cap 601. For example, a ridge (not shown) may be provided on cap 601 that may contact a reciprocal ridge on the interior of radial cap portion 504 or on the exterior of rigid frame 626, or both. Cap 601 may "click" as it passes each ridge, thereby informing a user, depending on the number of "clicks," approximately how much substance is being dispensed. It will be understood that for a given travel distance of cap 601, each chamber need not dispense the same quantity of substance. For example, a plurality of chamber may be provided, each attached to rigid frame 626 via its respective cylindrical sleeves 644, and the amount of substance dispensed may vary, for example, based on the type of substance within each chamber.

In some embodiments, cap 601 may be configured to only select a single chamber. In some embodiments, cap 601 may be configured to select more than one chamber. For example, the selecting rib 616 of cap 601 may be configured to align with the dispenser heads 642 of more than one chamber (not shown). In each of these embodiments, however, it will be understood that cap 601 may substantially prevent the non-selected chambers from being actuated.

Figure 74:
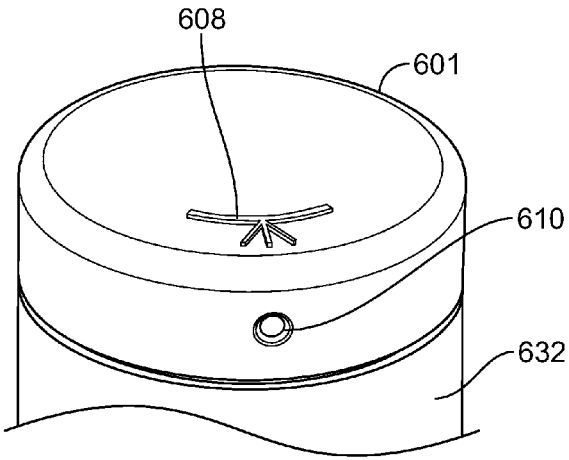
FIG. 74 shows a perspective view of the illustrative multi-chamber dispenser of FIG. 67 according to an embodiment of the invention.

There may be one or more lockout positions of dispenser 600 that may prevent a user from actuating any one of the one or more chambers 611-614 of dispenser 600. FIG. 74 shows an embodiment of illustrative dispenser 600 in a lockout position. The spray nozzle of any one of chambers 611-614 may be substantially sealed by radial portion 604 of cap 601. For example, as shown in FIG. 74, cap 601 is rotated such that no spray nozzle is aligned with slot 610. Moreover, the selecting rib 616 of cap 601 may not touch any of dispenser heads 642. Thus, while cap 601 may still be depressed and may travel downwards, cap 601 may not actuate any of chambers 611-614. In this illustrative example, cap 601 has been rotated 45-degrees clockwise from the application position shown in FIG. 73.

Example 7

FIGS. 75-86 show various perspectives and cross-sections of an illustrative multi-chamber spray dispenser according to various embodiments of the present invention. Multi-chamber dispenser 700 may include one or more spray bottles/cartridges or removable chambers 711-714 that may be removably fastened to a rigid frame of dispenser 700 (e.g., rigid frame 726 of FIG. 81). A housing 732 may substantially enclose the one or more removable chambers attached to dispenser 700. Housing 732 of dispenser 700 may therefore provide an interface by which a user may hold and/or operate dispenser 700 and may be configured for grasping thereof by a user's hand. In some embodiments, for example, housing 732 may be textured to increase the friction between housing 732 and a user's hand. Alternatively or additionally, in some embodiments housing 732 may be covered or wrapped with an elastic or flexible material including various rubbers, polymers, nylons, or any other suitable elastic or flexible material, or combinations thereof that may increase the friction between housing 732 and a user's palm. It will be understood that in some embodiments materials may be chosen without regard, or with relatively less regard, to friction.

In some embodiments, a housing end cap 733 may be provided at the bottom of dispenser 700 and may be configured to seal or substantially seal chambers 711-714 within housing 732. For example, housing end cap 733 may be provided with screw threads designed to mate with complementary internal threads on the bottom lip of housing 732, although any other suitable technique for fastening housing end cap 733 to housing 732 may be used. It will be understood that in some embodiments, no housing end cap 733 may be provided and chambers 711-714 may therefore be viewable through the bottom of housing 732. Further, in some embodiments, there may be no opening at the bottom of housing 732 (not shown) and chambers 711-714 may therefore be sealed or substantially sealed within housing 732 without the need to provide a housing end cap such as housing end cap 733.

Although dispenser 700 is shown as having up to four removable chambers 711-714, it will be understood that any suitable number of removable chambers may be provided. Moreover, although each removable chamber 711-714 is shown as being substantially the same type (i.e., a spray bottle), it will be understood that any suitable type of removable chamber may be provided (e.g., various pump bottles and spray bottles or cartridges) in any suitable combination, and each chamber may contain any suitable respective substance or substances that may be dispensed by dispenser 700. Each of chambers 711-714 may contain the same substance or may contain different substances as any one or more of the other chambers.

A cap 701 may be positioned at a dispensing end of dispenser 700 and may include a top portion 702, a radial portion 704, and a button or actuator 703. Cap 701 may be rotatable to various dispensing/application positions. For example, as shown in FIGS. 75-78, cap 701 is rotated to an application position for first spray bottle or removable chamber 711. A plurality of slots 710 may be provided about housing 732 and may be configured to allow a dispenser head, such as dispenser head 742 of FIG. 81, to dispense a substance from a selected chamber therethrough. Although the cross-sectional area of slot 710 is substantially oval-shaped, it may be any other suitable shape, and of any other suitable size, configured to allow a dispenser head to dispense a substance therethrough. For example, the cross-sectional area of slot 710 may be substantially rectangular, triangular, circular or elliptical, hexagonal, any other desired shape, or any combination thereof.

A chamber may be selected and/or actuated according to various embodiments as shown in FIGS. 79-84. The interior of cap 701 may include a selecting rib 716 of actuator 703. The user may select chamber 711, for example, by rotating cap 701 into an application position (whereby the selecting rib 716 may be aligned with tab 719 and dispenser head 742 proximate to first chamber 711) and pressing or actuating actuator 703 axially downwards, which each time sprays a quantity of fluid or other substance from at least one of removable chambers 711-714, the quantity of fluid or other substance determined by the internal and/or external characteristics of the respective chamber. For example, each depression of actuator 703, thereby actuating dispenser head 742 of chamber 711, may cause a preferred amount of substance to be expelled from within a dispensing chamber (e.g., dispensing chamber 711).

Figure 81:
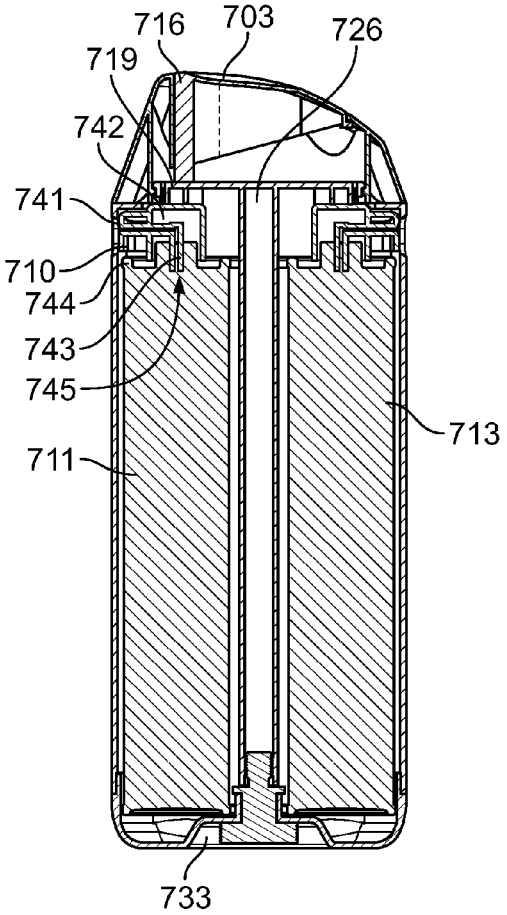
FIG. 81 shows a schematic cross-sectional view of the illustrative multi-chamber dispenser of FIG. 79, taken along line B-B, according to an embodiment of the invention.
Figure 84:
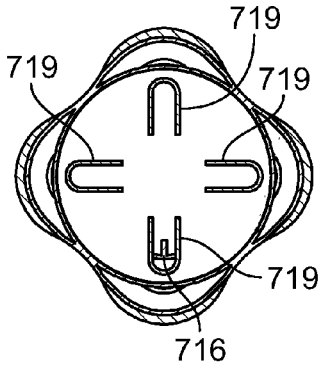
FIG. 84 shows a schematic cross-sectional view of the illustrative multi-chamber dispenser of FIG. 82, taken along line D-D, according to an embodiment of the invention.
Figure 82:
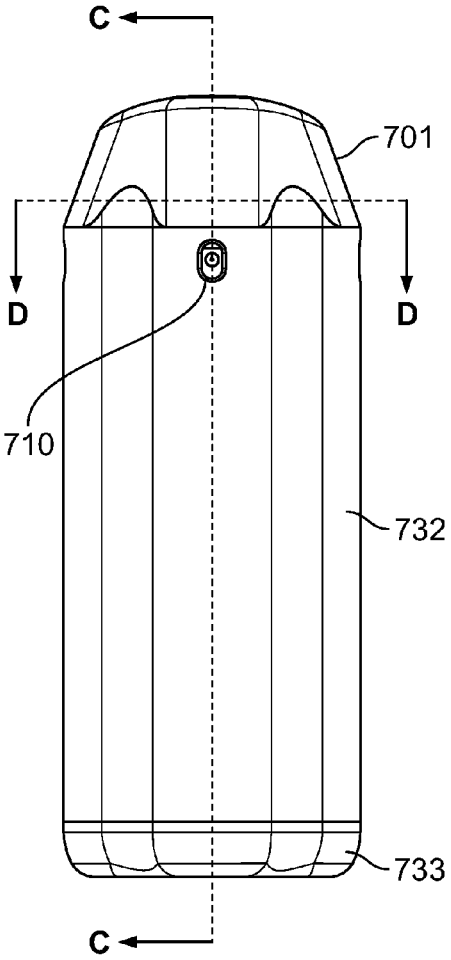
FIG. 82 shows a front elevation view of the illustrative multi-chamber dispenser of FIG. 75 according to an embodiment of the invention.
Figure 83:
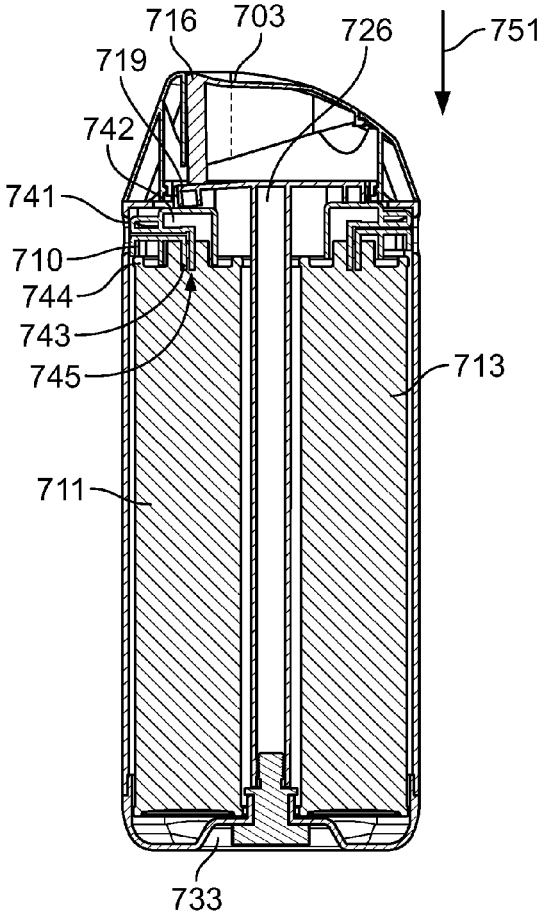
FIG. 83 shows a schematic cross-sectional view of the illustrative multi-chamber dispenser of FIG. 82, taken along line C-C, according to an embodiment of the invention.

As shown in FIGS. 81 and 83, for example, in order to dispense the substance or substances of selected chamber 711, actuator 703 may be pressed axially downwards (in the direction of arrow 751), thereby actuating dispenser head 742 that is engaged with tab 719 and the selecting rib 716. Actuator 703 may translate downward towards chambers 711-714 until dispenser head 742 is substantially fully depressed. This may actuate a spray valve within selected chamber 711 and cause the contents of chamber 711 to be dispensed via dispensing conduit inlet 745, dispensing conduit 743, and nozzle 741, for example, as described above in connection with spray valve 540 of FIG. 61.

In some embodiments, one or more ridges may be provided that may provide tactile feedback as a user depresses actuator 703. For example, a ridge (not shown) may be provided on actuator 703 that may contact a reciprocal ridge on the interior of top cap portion 702. Actuator 703 may "click" as it passes each ridge, thereby informing a user, depending on the number of "clicks," approximately how much substance is being dispensed. It will be understood that for a given travel distance of actuator 703, each chamber need not dispense the same quantity of substance. For example, a plurality of chamber may be provided, each attached to rigid frame 726 via its respective cylindrical sleeves 744, and the amount of substance dispensed may vary, for example, based on the type of substance within each chamber.

In some embodiments, actuator 703 may be configured to only select a single chamber. In some embodiments, actuator 703 may be configured to select more than one chamber. For example, the selecting rib 716 of actuator 703 may be configured to align with the dispenser heads 742 (or tabs 719) of more than one chamber (not shown). In each of these embodiments, however, it will be understood that actuator 703 may substantially prevent the non-selected chambers from being actuated.

Figure 86:
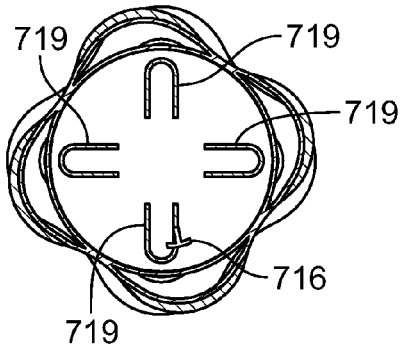
FIG. 86 shows a schematic cross-sectional view of the illustrative multi-chamber dispenser of FIG. 85, taken along line E-E, according to an embodiment of the invention.
Figure 85:
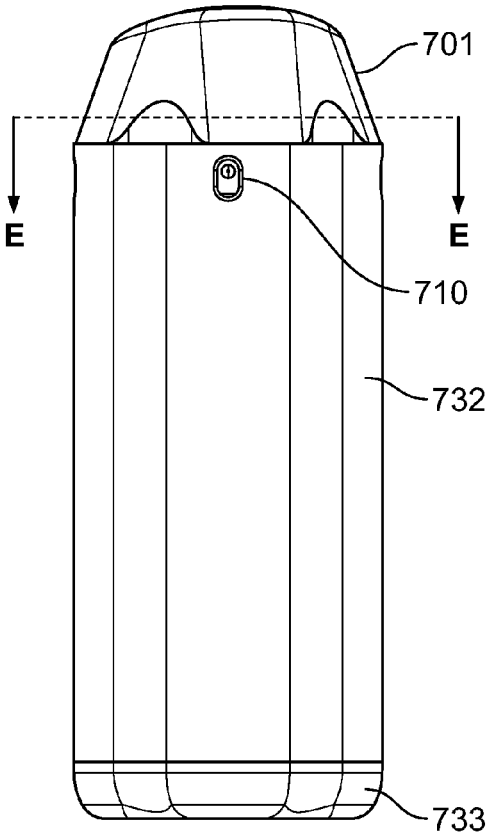
FIG. 85 shows a front elevation view of the illustrative multi-chamber dispenser of FIG. 75 according to an embodiment of the invention.

There may be one or more lockout positions of dispenser 700 that may prevent a user from actuating any one of the one or more chambers 711-714 of dispenser 700. FIGS. 85 and 86 shows an embodiment of illustrative dispenser 700 in a lockout position. For example, as shown in FIG. 86, cap 701 may be rotated such that the selecting rib 716 of actuator 703 may not be aligned with any tabs 719. Thus, while actuator 703 may still be depressed and may travel downwards, actuator 703 may not actuate any of chambers 711-714. In this illustrative example, cap 701 has been rotated counter-clockwise from the application position shown in FIG. 80.

The caps of the invention (e.g., cap 101 of FIG. 1), may be formed of any suitable durable and substantially rigid material, including, but not limited to, various polymers such as polyethylene (including high density polyethylene, low density polyethylene, and polyethylene terephthalate), polypropylene, polyvinyl chloride, polystyrene, post-consumer resins, or any other suitable moldable polymers including biodegradable polymers such as polylactide; various metals including steel, tin, aluminum, or any other suitable metals or alloys; any other suitable material; or combinations thereof.

The rigid frames of each dispenser of the invention (e.g., rigid frame 126 of FIG. 1) may be formed of any suitable material that may support one or more chambers, including, but not limited to, various polymers such as polyethylene (including high density polyethylene, low density polyethylene, and polyethylene terephthalate), polypropylene, polyvinyl chloride, polystyrene, post-consumer resins, or any other suitable moldable polymers including biodegradable polymers such as polylactide; various metals including steel, tin, aluminum, or any other suitable metals or alloys; any other suitable material; or combinations thereof.

The dispenser housing of the invention (e.g., housing 532 of FIG. 5) may be formed of any suitable material that may substantially contain or enclose the chambers of the dispenser, including, but not limited to, nylon, or any other polymer or elastic material, including reinforced composites, nitrile rubber, polysulfone, or any other suitable polymer discussed above, or any other substantially rigid material, such as enamel coated steel or any other metal or alloy, any other suitable material, or combinations thereof.

The pump bottle chambers of the present invention (e.g., chamber 111 of FIG. 1) may be made of any suitable material that may effectively contain a substance therein including, but not limited to, various polymers such as polyethylene (including high density polyethylene, low density polyethylene, and polyethylene terephthalate), polypropylene, polyvinyl chloride, polystyrene, post-consumer resins, or any other suitable moldable polymers including biodegradable polymers such as polylactide; various metals including steel, tin, aluminum, or any other suitable metals or alloys; any other suitable material; or combinations thereof.

The aerosol spray bottles/cartridges of the invention (e.g., chamber 511 of FIG. 59) may be formed of any suitable material or combination of materials that may effectively seal a substance therein including, but not limited to, various tinplates, steels, aluminums or other alloys, plastics (including any of the polymers discussed above), glass, any other suitable material, or combinations thereof.

In some embodiments of the invention, the thicknesses and materials of each one of the chambers and the substances therein may differ from one another. As another example, the chambers used within each dispenser may also vary based upon the respective substance or substances contained therein. For example, a first chamber may include a substance formed of a first type of material having a first set of properties, while a second chamber may include a substance formed of a second type of material having a second set of properties. The chambers may be designed based on the material properties of the respective first and second substances.

Although each of the above described and illustrated embodiments of a multi-chamber dispenser show a plurality of chambers extending axially downward, it will be understood that each chamber may be provided in any orientation. Moreover, although each of the above described and illustrated embodiments of a multi-chamber dispenser show the spray bottle chambers having substantially round cross-sections, it should be noted that any of a wide variety of shapes may be utilized to form the chambers. For example, the chambers may have cross-sectional areas that are circular, rectangular, triangular, hexagonal, or any other desired shape or combination thereof.

It will be understood that the foregoing is only illustrative of the principles of the invention, and that various modifications may be made by those skilled in the art without departing from the scope and spirit of the invention. It will also be understood that various directional and orientational terms such as "horizontal" and "vertical," "top" and "bottom" and "side," "length" and "width" and "height" and "thickness," "inner" and "outer," "internal" and "external," and the like are used herein only for convenience, and that no fixed or absolute directional or orientational limitations are intended by the use of these words. For example, the devices of this invention, as well as their individual components, may have any desired orientation. If reoriented, different directional or orientational terms may need to be used in their description, but that will not alter their fundamental nature as within the scope of this invention. Those skilled in the art will appreciate that the invention may be practiced by other than the described embodiments, which are presented for purposes of illustration rather than of limitation, and the invention is limited only by the claims that follow.

What is claimed is:

1. A multi-chamber dispenser comprising:

a rigid frame portion that is configured to be coupled with a plurality of chambers;

a shared dispensing conduit, coupled to the rigid frame portion, for passage of a respective substance from each of the plurality of chambers to a common dispensing outlet, the shared dispensing conduit including a plurality of channels, each respective channel configured to be associated with a respective chamber and to prevent mixing of the respective substances; and a rotatable cap positioned at a dispensing end of the dispenser and coupled to the rigid frame portion, wherein the rotatable cap is configured to (a) rotate to a plurality of positions and (b) actuate one of the plurality of chambers to dispense that chamber's substance, and wherein the multi-chamber dispenser lacks any position at which more than one of the plurality of chambers is actuated to dispense a substance.

2. The multi-chamber dispenser of claim 1 wherein at least one of the plurality of chambers is removably coupled to the rigid frame portion.

3. The multi-chamber dispenser of claim 1 wherein at least one of the plurality of chambers is permanently coupled to the rigid frame portion.

4. The multi-chamber dispenser of claim 1 further comprising a pump, wherein the respective substance from one of the plurality of chambers is dispensed in response to the rotatable cap actuating the pump using an actuator.

5. The multi-chamber dispenser of claim 1 wherein each of the chambers is configured to couple with an external pump.

6. The multi-chamber dispenser of claim 5 wherein each of the chambers is operable to dispense that respective chamber's substance, via the external pump, when that chamber is not coupled to the rigid frame portion.

7. The multi-chamber dispenser of claim 4 wherein the pump is fixedly coupled to the rigid frame portion.

8. The multi-chamber dispenser of claim 1 further comprising a dispensing outlet in the rotatable cap through which a nozzle dispenses the respective substance from one of the plurality of chambers.

9. The multi-chamber dispenser of claim 8 wherein the nozzle is concentric to the dispensing outlet and remains concentric with the dispensing outlet when at least one of the plurality of chambers is actuated.

10. The multi-chamber dispenser of claim 1 further comprising a rigid housing that fully encloses the plurality of chambers.

11. The multi-chamber dispenser of claim 1 wherein the dispenser is configured to operate when less than all of the plurality of chambers are coupled to the rigid frame portion.

12. The multi-chamber dispenser of claim 1 wherein at least one of the plurality of chambers is variable in size relative to another of the plurality of chambers.

13. The multi-chamber dispenser of claim 1 wherein the rotatable cap is further configured to rotate to a lockout position at which each of the plurality of chambers is prevented from being actuated.

14. The multi-chamber dispenser of claim 1 wherein the rigid frame portion comprises a docking dovetail configured to couple to at least one of the plurality of chambers.

15. The multi-chamber dispenser of claim 1 wherein the dispenser is configured to dispense the respective substance from at least one of the plurality of chambers from any orientation of the dispenser.

16. The multi-chamber dispenser of claim 1 wherein the substance comprises a fluid.

17. The multi-chamber dispenser of claim 16 wherein the fluid is selected from the group consisting of cosmetics, suntan lotion, shaving cream, shampoo, conditioner, liquid soap, and spray paint.

18. A multi-chamber dispenser comprising:

a plurality of chambers;

a rigid frame portion coupled with the plurality of chambers, wherein the interior of each of the plurality of chambers is configured to contain a respective substance;

a shared dispensing conduit, coupled to the rigid frame portion, for passage of the respective substance from each of the plurality of chambers to a common dispensing outlet, the shared dispensing conduit including a plurality of channels, each respective channel associated with a respective chamber, wherein the channels prevent mixing of the respective substances; and a rotatable cap positioned at a dispensing end of the dispenser and coupled to the rigid frame portion, wherein the rotatable cap is configured to (a) rotate to a plurality of positions and (b) actuate one of the plurality of chambers to dispense that chamber's substance, and wherein the multi-chamber dispenser lacks any position at which more than one of the plurality of chambers is actuated to dispense a substance.

19. The multi-chamber dispenser of claim 13 wherein the rotatable cap comprises a rib that, when the rotatable cap is in the lockout position, interfaces with a surface of the rigid frame portion to prevent the plurality of chambers from being actuated.

* * * * *